US011415917B2

(12) United States Patent
Ichinose et al.

(10) Patent No.: US 11,415,917 B2
(45) Date of Patent: Aug. 16, 2022

(54) IMAGE FORMING APPARATUS

(71) Applicant: BROTHER KOGYO KABUSHIKI KAISHA, Nagoya (JP)

(72) Inventors: Yuichiro Ichinose, Nagoya (JP); Kenta Tosuji, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/381,298

(22) Filed: Jul. 21, 2021

(65) Prior Publication Data

US 2022/0026838 A1 Jan. 27, 2022

(30) Foreign Application Priority Data

Jul. 22, 2020 (JP) ..... JP2020-125383

(51) Int. Cl.
*G03G 15/23* (2006.01)
*B65H 85/00* (2006.01)
*G03G 21/16* (2006.01)

(52) U.S. Cl.
CPC ..... *G03G 15/234* (2013.01); *B65H 85/00* (2013.01); *G03G 15/23* (2013.01); *G03G 15/231* (2013.01); *G03G 15/232* (2013.01); *G03G 21/1685* (2013.01); *G03G 21/1695* (2013.01)

(58) Field of Classification Search
CPC .... G03G 15/23; G03G 15/231; G03G 15/232; G03G 15/234; G03G 15/235; G03G 15/237; G03G 21/1685; G03G 21/1695; B65H 85/00
See application file for complete search history.

(56) References Cited

U.S. PATENT DOCUMENTS 5,612,771 A 3/1997 Yamamoto et al.
2009/0184461 A1* 7/2009 Ishikawa ..... B65H 5/36 271/254
2015/0274460 A1* 10/2015 Hirata ..... B65H 9/04 271/3.2

(Continued)

FOREIGN PATENT DOCUMENTS

JP H10-148973 A 6/1998
JP H11-288207 A 10/1999

(Continued)

*Primary Examiner* — Joseph S Wong
(74) *Attorney, Agent, or Firm* — Scully, Scott, Murphy & Presser, PC

(57) ABSTRACT

An image forming apparatus includes an image formation engine configured to form an image on a sheet, and a re-conveyer configured to convey the sheet having an image formed on one surface thereof by the image formation engine to the image formation engine again along a re-conveying path. The re-conveyer includes a conveying roller configured to convey the sheet in a re-conveying direction toward the image formation engine, a first guide member configured to be swingable between a first position at which the first guide member defines a portion of the re-conveying path upstream of the conveying roller in the re-conveying direction and guides the sheet to the conveying roller and a second position for exposing the potion of the re-conveying path, and a support member configured to swingably support the first guide member and rotatably support the conveying roller.

12 Claims, 12 Drawing Sheets

(56) References Cited

U.S. PATENT DOCUMENTS

| | | | | |
|---|---|---|---|---|
| 2016/0154348 | A1 | 6/2016 | Fukase | |
| 2016/0289036 | A1* | 10/2016 | Kosaka | B65H 85/00 |
| 2017/0355545 | A1 | 12/2017 | Iwama | |

FOREIGN PATENT DOCUMENTS

| | | | |
|---|---|---|---|
| JP | 2000-081799 | A | 3/2000 |
| JP | 2007-292984 | A | 11/2007 |
| JP | 2016-102936 | A | 6/2016 |
| JP | 2017-219739 | A | 12/2017 |

* cited by examiner

IMAGE FORMING APPARATUS

CROSS-REFERENCE TO RELATED APPLICATION

This application claims priority under 35 U.S.C. § 119 from Japanese Patent Application No. 2020-125383 filed on Jul. 22, 2020. The entire subject matter of the application is incorporated herein by reference.

BACKGROUND

Technical Field

Aspects of the present disclosure relate to an image forming apparatus.

Related Art

There has been known an image forming apparatus provided with an image formation engine and a re-conveyer.

The image formation engine forms an image on a sheet. The re-conveyer conveys the sheet having an image formed on one surface thereof by the image formation engine to the image formation engine again along a re-conveying path.

There is known a conventional image forming apparatus, in which the re-conveyer includes intermediate conveying rollers and a guide member. The intermediate conveying rollers convey the sheet in a re-conveying direction toward the image formation engine. The guide member defines a portion of the re-conveying path upstream of the intermediate conveying rollers in the re-conveying direction. The guide member guides the sheet to the intermediate conveying rollers.

In the conventional image forming apparatus, a swing shaft is provided at a lower end of the guide member. Thus, the guide member is swingable between a first position for closing a portion of the re-conveying path and a second position for exposing the portion of the re-conveying path.

In the conventional image forming apparatus, it is possible to perform operations such as removal of a sheet jammed around the conveying rollers by swinging the guide member to the second position.

SUMMARY

In the above-described conventional image forming apparatus, no measures are taken to improve a positional relationship between the guide member at the first position and the intermediate conveying roller. Therefore, it is likely that a position at which a leading edge of the sheet guided to the intermediate conveying rollers by the guide member at the first position contacts the intermediate conveying rollers varies widely and, as a result, sheet jamming could occur around the intermediate conveying rollers.

According to aspects of the present disclosure, there is provided an image forming apparatus including an image formation engine configured to form an image on a sheet, and a re-conveyer configured to convey the sheet having an image formed on one surface thereof by the image formation engine to the image formation engine again along a re-conveying path. The re-conveyer includes a conveying roller configured to convey the sheet in a re-conveying direction toward the image formation engine, a first guide member configured to be swingable between a first position at which the first guide member defines a portion of the re-conveying path upstream of the conveying roller in the re-conveying direction and guides the sheet to the conveying roller and a second position for exposing the potion of the re-conveying path, and a support member configured to swingably support the first guide member and rotatably support the conveying roller.

BRIEF DESCRIPTION OF THE ACCOMPANYING DRAWINGS

DETAILED DESCRIPTION

Hereinafter, embodiments according to aspects of the present disclosure will be described with reference to the drawings.

Figure 1:
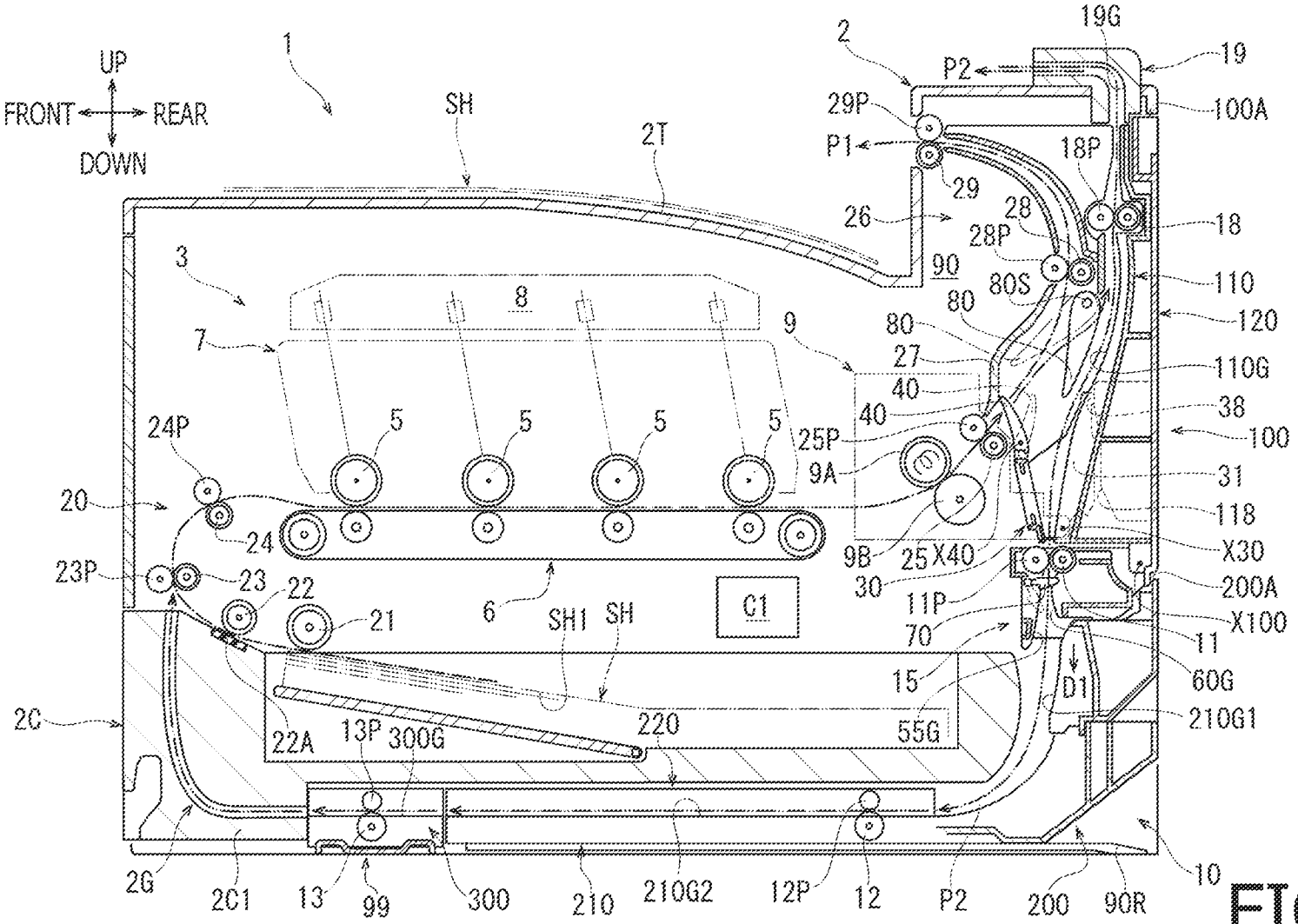
FIG. 1 is a schematic cross-sectional view of an image forming apparatus according to an embodiment, illustrating a state in which a first guide member is at a first position and a second guide member is at a third position.

FIG. 1 shows an image forming apparatus 1 according to an embodiment of the present disclosure. The image forming apparatus 1 is a laser printer that forms an image on a sheet SH using an electrophotographic system.

<Configuration of Main Body, Conveying Path, Feeder, Image Formation Engine, and Ejector>

As shown in FIG. 1, the image forming apparatus 1 includes a main body 2, a feeder 20, an image formation engine 3 and an ejector 26. The feeder 20 is provided at a front portion of the main body 2. The ejector 26 is provided at an upper rear portion of the main body 2. A front-rear direction and an up-down direction shown in every figure on and after FIG. 2 all correspond to the front-rear direction and the up-down direction shown in FIG. 1.

Figure 2:
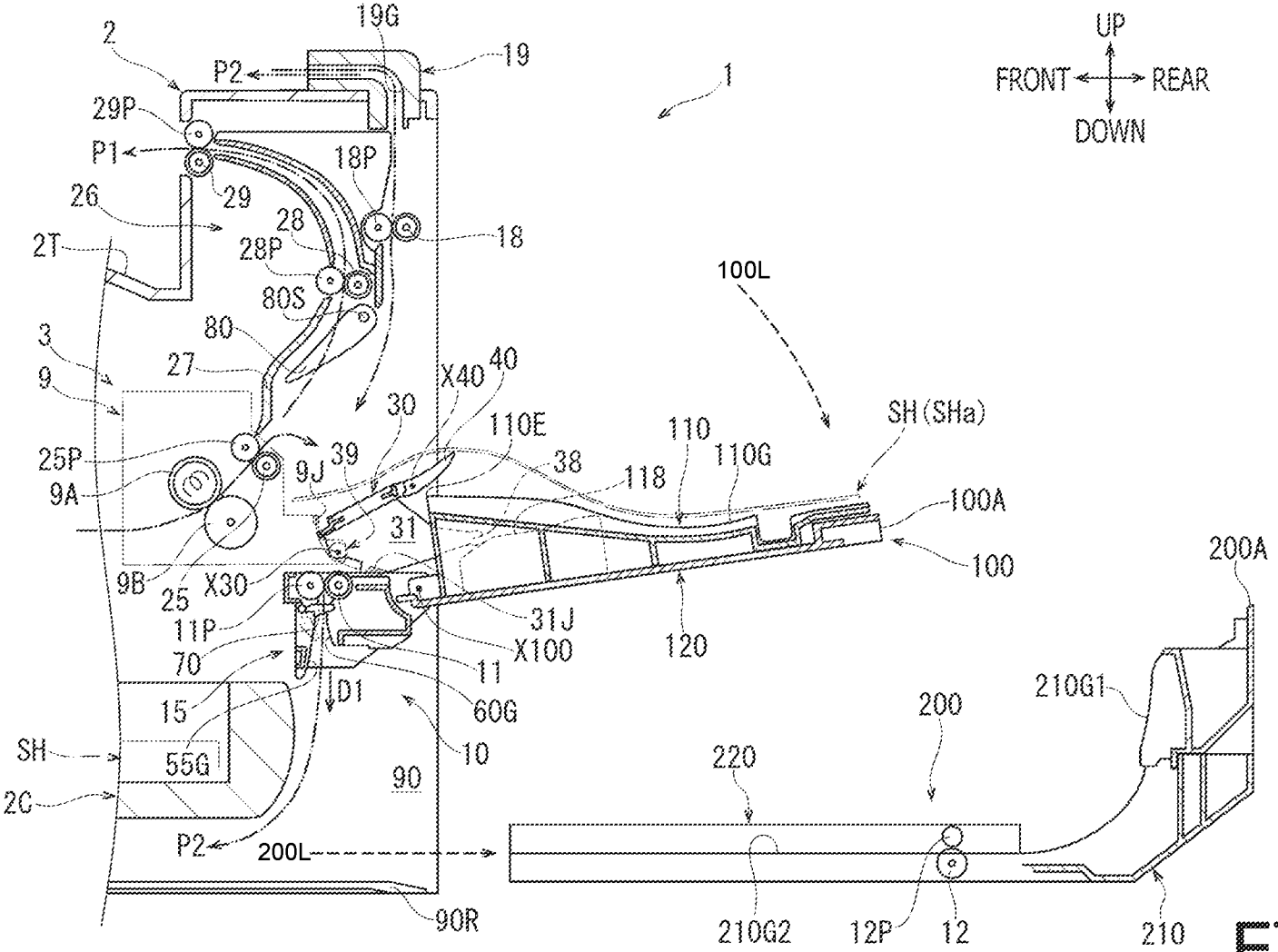
FIG. 2 is a partial schematic cross-sectional view of the image forming apparatus according to the embodiment, illustrating a state in which the first guide member swung to a second position and the second guide member slid to a fourth position from the state shown in FIG. 1.

As shown in FIGS. 1 and 2, the main body 2 includes a housing and a not-shown inner frame provided in the housing. The main body 2 further includes a pair of side frames 90. In FIGS. 1 and 2, one side frame 90 positioned on the back side of the paper is shown, and the other side frame 90 positioned on the front side of the paper is not shown.

The side frames 90 are disposed on one side and the other side of the main body 2, respectively. Each side frame 90 extends in the up-down direction from a lower end to an upper end of the main body 2, and extends in the front-rear direction from a front end to a rear end of the apparatus main body 2. As shown in FIG. 1, front portions of lower ends of the pair of side frames 90 are connected to each other by a beam member 99.

A sheet tray 2C is provided at a lower portion of the main body 2. The sheet tray 2C is a substantially box-shaped body whose upper side is open, and accommodates a plurality of sheets SH in a stacked state. The sheet SH is an ordinary sheet, an OHP sheet, a thick sheet, or the like.

A discharge tray 2T is provided on an upper surface of the main body 2. The sheet SH on which an image has been formed is discharged to the discharge tray 2T.

A conveying path P1 is provided inside the main body 2. The conveying path P1 is a substantially S-shaped path that extends upward from a front end portion of the sheet tray 2C to be curved in a U-shape, extends rearward substantially horizontally, and further extends upward at the back of the main body 2 to be curved in a U-shape to reach the discharge tray 2T.

A controller C1 is provided in the main body 2. The controller C1 includes an arithmetic unit consisting mainly of conventionally-known CPU, ROM and RAM, and hardware configured to control semiconductor lasers, motors, and the like. The ROM stores one or more programs for the CPU to control various operations of the image forming apparatus 1, one or more programs for executing identification processing, and the like. The RAM is used as a storage area for temporarily storing data and signals used when the CPU executes the above-mentioned programs or as a work area for data processing. The controller C1 controls the entire image forming apparatus 1 including the feeder 20, the image formation engine 3 and the ejector 26.

The feeder 20 feeds the sheets SH stored in the sheet tray 2C one by one to the conveying path P1 with a feed roller 21, a separation roller 22 and a separation pad 22A. Then, the feeder 20 conveys the sheet SH toward the image formation engine 3 with the post-separation conveying roller pair 23, 23P and a registration roller pair 24, 24P provided in a section of the conveying path P1 at the front of the main body 2 that has a U-shape when viewed from a side (i.e., when viewed in an axial direction of a photoconductor which will be described later).

The image formation engine 3 is provided within the main body 2 above the sheet tray 2C. The sheet SH conveyed toward the image formation engine 3 by the feeder 20 passes through the image formation engine 3 at a portion of the conveying path P1 that extends substantially horizontally.

The image formation engine 3 is a direct transfer type color electrophotographic system. The image formation engine 3 includes a process cartridge 7, a transfer belt 6, a scanner 8 and a fuser 9, which are well-known components.

The process cartridge 7 is an assembly of four cartridges which correspond to toners of four colors of black, yellow, magenta and cyan and are arranged in series along the substantially horizontal portion of the conveying path P1. The process cartridge 7 includes four photoconductors 5 corresponding to the toners of the respective colors and conventionally-known developing rollers, chargers and toner containers.

Each photoconductor 5 is a cylindrical rotating body that rotates about a photoconductor axis. A positively chargeable photosensitive layer is formed on a surface of each photoconductor 5.

An axial direction of the photoconductor is perpendicular to the front-rear direction and the up-down direction. The axial direction of the photoconductor shown in every figure on and after FIG. 4 corresponds the axial direction shown in FIG. 1. One side in the axial direction of the photoconductor corresponds to the front side of the paper of FIG. 1, and the other side in the axial direction of the photoconductor corresponds to the back side of the paper of FIG. 1.

As shown in FIG. 1, the transfer belt 6 is positioned below the substantially horizontal portion of the conveying path P1, and faces the photoconductors 5 from below. The transfer belt 6 circulates while nipping the conveyed sheet SH between the transfer belt 6 and each photoconductor 5.

The scanner 8 is disposed above the process cartridge 7. The scanner 8 includes a laser light source, a polygon mirror, an f θ lens, and a reflection mirror. The scanner 8 irradiates each photoconductor 5 in the process cartridge 7 with a laser beam from above.

The fuser 9 is provided at a position behind the process cartridge 7. The fuser 9 includes a heating roller 9A, a pressing roller 9B and a post-fixing conveying roller pair 25, 25P. The heating roller 9A, the pressing roller 9B and the post-fixing conveying roller pair 25, 25P are provided at a lower portion of a section of the conveying path P1 at the back of the apparatus main body 2 that has a U-shape when viewed in the axial direction of the photoconductor.

The fuser 9 nips the sheet SH having passed below the process cartridge 7 between the heating roller 9A and the pressing roller 9B to heat and press the sheet SH. The post-fixing conveying roller pair 25, 25P conveys the sheet SH having passed between the heating roller 9A and the pressing roller 9B toward the ejector 26.

The ejector 26 includes a pre-discharge conveying roller pair 28, 28P and a discharge roller pair 29, 29P. The pre-discharge conveying roller pair 28, 28P is provided at an intermediate portion of the U-shaped section of the conveying path P1 at the back of the apparatus main body 2. The discharge roller pair 29, 29P is disposed at an upper end of the U-shaped section of the conveying path P1 at the back of the apparatus main body 2, that is, at the most downstream side of the conveying path P1.

The ejector 26 nips the sheet SH having passed through the fuser 9 with the pre-discharge conveying roller pair 28, 28P to convey the sheet SH toward the discharge roller pair 29, 29P, and further nips the sheet SH with the discharge roller pair 29, 29P to discharge the sheet SH to the discharge tray 2T. It should be noted that, depending on a print mode, by nipping the sheet SH having passed through the fuser 9 with the pre-discharge conveying roller pair 28, 28P and the discharge roller pair 29, 29P and partially discharging the sheet SH, and then switching rotation directions of the pre-discharge conveying roller pair 28, 28P and the discharge roller pair 29, 29P to directions opposite to those for discharge, the sheet SH can switch back toward a conveying roller 11 which will be described later.

Figure 3:
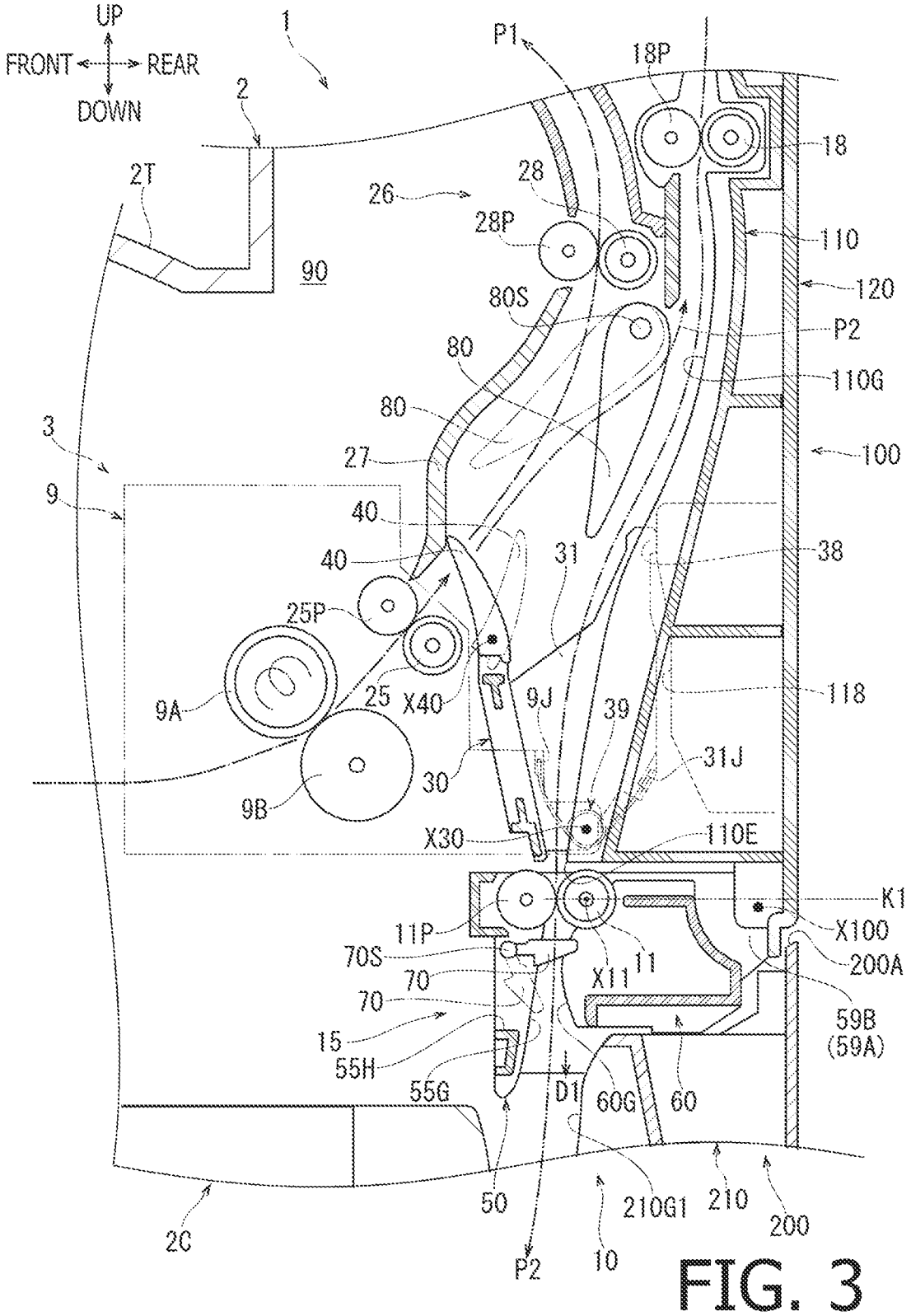
FIG. 3 is an enlarged partial schematic cross-sectional view showing the first guide member, the support member and their surroundings shown in FIG. 1.

As shown enlarged in FIG. 3, the image forming apparatus 1 includes a post-fixing guide wall 27, a path switching flapper 80, a flapper 40, and a flapper support member 30.

The post-fixing guide wall 27 defines a section of the conveying path P1 between the post-fixing conveying roller pair 25, 25P and the pre-discharge conveying roller pair 28, 28P from the front. The path switching flapper 80 is disposed below a driving roller 28 of the pre-discharge conveying roller pair 28, 28P. The path switching flapper 80 is swingable about a switching axis 80S between a position indicated by a solid line and a position indicated by a chain double-dashed line in FIG. 3.

When the path switching flapper 80 is at the position indicated by the solid line in FIG. 3, a lower end of the path switching flapper 80 is separated rearward from the post-fixing guide wall 27. Thus, the sheet SH conveyed by the post-fixing conveying roller pair 25, 25P is guided by the post-fixing guide wall 27 and the path switching flapper 80 toward the pre-discharge conveying roller pair 28, 28P.

As will be described later, when re-conveying the sheet SH, the controller C1 swings the path switching flapper 80 to the position indicated by the chain double-dashed line in FIG. 3. In a state where the path switching flapper 80 is at the position indicated by the chain double-dashed line in FIG. 3, the lower end of the path switching flapper 80 approaches the post-fixing guide wall 27 to block the conveying path P1. Thus, the sheet SH conveyed by the post-fixing conveying roller pair 25, 25P is guided to behind the pre-discharge conveying roller pair 28, 28P by the path switching flapper 80 and toward a switchback roller pair 18, 18P which will be described later.

Specific configurations of the flapper 40 and the flapper support member 30 will be described later. The flapper 40 and the flapper support member 30 are provided behind the fuser 9. The flapper support member 30 extends upward from its lower end and is inclined forward so as to approach the post-fixing conveying roller pair 25, 25P. The flapper 40 is supported by an upper portion of the flapper support member 30 so as to be swingable about the first axis X40. The flapper 40 is swingable between a restricting position indicated by a solid line in FIG. 3 and a retracted position indicated by a chain double-dotted line in FIG. 3, and is biased toward the restricting position.

The restricting position of the flapper 40 is a position where the flapper 40 extends upward from the first axis X40 and is inclined forward to block the conveying path P1. The restricting position of the flapper 40 is determined by the upper end of the flapper 40 contacting with the post-fixing guide wall 27. As will be described later, in a state where the flapper 40 is at the restricting position, the flapper 40 restricts the sheet SH guided by the first guide member 100 from advancing toward the fuser 9.

The retracted position of the flapper 40 is a position at which the flapper 40 is pressed by the sheet SH having passed through the fuser 9 and is swung rearward from the restricting position. At the retracted position, the flapper 40 allows the sheet SH conveyed by the post-fixing conveying roller pair 25, 25P to pass through.

The image formation engine 3 forms an image on the sheet SH conveyed along the conveying path P1 in the following manner. The surface of each photoconductor 5 is uniformly positively charged by the charger as the photoconductor 5 rotates, and then is exposed by high-speed scanning with a laser beam emitted from the scanner 8. Thus, an electrostatic latent image corresponding to an image to be formed on the sheet SH is formed on the surface of each photoconductor 5. Next, the toner is supplied from the toner container to the surface of each photoconductor 5 in accordance with the electrostatic latent image. In a state where the sheet SH is accommodated in the sheet tray 2C, one surface SH1 of the sheet SH faces downward. When the sheet SH is conveyed along the conveying path P1 and passes through the image formation engine 3, one surface SH1 of the sheet SH faces upward and faces the photoconductors 5. Therefore, the toner carried by the surface of each photoconductor 5 is transferred to one surface SH1 of the sheet SH. Then, in the fuser 9, the sheet SH is heated and pressed to thermally fix the image on the sheet SH.

The sheet SH having passed through the fuser 9 causes the flapper 40 to swing toward the retracted position indicated by the chain double-dashed line in FIG. 1, is guided by the post-fixing guide wall 27 and the path switching flapper 80 at the position indicated by the solid line in FIG. 1, is nipped by the pre-discharge conveying roller pair 28, 28P, is further nipped by the discharge roller pair 29, 29P and is discharged to the discharge tray 2T.

<Brief Configuration of Re-Conveying Path and Re-Conveyer>

A re-conveying path P2 for forming an image on a surface opposite to one surface SH1 of the sheet SH is provided in the main body 2. Further, a switchback guide part 19 is provided at a rear end of the upper surface of the main body 2.

A lower portion of the switchback guide part 19 protrudes into the main body 2. An upper portion of the switchback guide part 19 projects forward above the main body 2. A temporary discharge passage 19G is formed in the switchback guide part 19. The temporary discharge passage 19G opens to a lower surface of the lower portion of the switchback guide part 19 and a front surface of the upper portion of the switchback guide part 19, and is bent in a substantially L-shape inside the switchback guide part 19.

When the controller C1 causes the path switching flapper 80 to swing to the position indicated by the chain double-dotted line in FIG. 1, the re-conveying path P2 branches from a position in the conveying path P1 immediately after passing through the fuser 9, advances upward along the path switching flapper 80, and temporarily enters the temporary discharge passage 19G of the switchback guide part 19.

Then, the re-conveying path P2 inverts its orientation to exit from the temporary discharge passage 19G, travels downward along the rear surface of the main body 2 and then changes its orientation to the forward direction. Then, the re-conveying path P2 extends forward substantially horizontally below the sheet tray 2C, further changes its orientation upward at the front of the main body 2, extends upward and merges with the conveying path P1 at a position immediately before the post-separation conveying roller pair 23, 23P.

A direction in which the sheet SH is conveyed along the re-conveying path P2 is referred to as a re-conveying direction D1. In a section in the re-conveying path P2 before the inverting, the re-conveying direction D1 is upward. In a section in the re-conveying path P2 after the inverting, the re-conveying direction D1 is downward up to the vicinity of a lower end of the rear surface of the main body 2, changes from downward to forward in the vicinity of the lower end of the rear surface, and changes to upward in the vicinity of a lower end of the front surface of the sheet tray 2C.

The image forming apparatus 1 includes a re-conveyer 10. The re-conveyer 10 includes a switchback roller pair 18, 18P, a support member 15, a conveying roller 11, a driven roller 11P, an actuator 70, a first guide member 100, a second guide member 200, an oblique feed roller pair 12, 12P, a third guide member 300, a return roller pair 13, 13P and a return guide part 2G.

The re-conveyer 10 conveys the sheet SH guided from the fuser 9 to the re-conveying path P2 to the image formation engine 3 again along the re-conveying path P2. Then, in the image formation engine 3, an image is also formed on the surface opposite to the one surface SH1 of the sheet SH, and the sheet SH is discharged on the discharge tray 2T. A specific configuration of the re-conveyer 10 will be described below in detail.

<Switchback Roller Pair>

As shown in FIG. 2, the switchback roller pair 18, 18P is disposed at a position behind and above the pre-discharge conveying roller pair 28, 28P and below the switchback guide part 19. The switchback roller pair 18, 18P is supported by the inner frame of the main body 2.

As shown in FIG. 1, the switchback roller pair 18, 18P is controlled by the controller C1 to rotate in the forward direction and nips the sheet SH guided from the fuser 9 to the re-conveying path P2 to convey the sheet SH upward toward the temporary discharge passage 19G of the switchback guide part 19.

Then, based on a detection result by a conventionally-known sheet sensor provided in the fuser 9, the controller C1 inverts the rotation of the switchback roller pair 18, 18P at a timing when a particular period of time elapsed after a rear end of the sheet SH conveyed upward by the switchback roller pair 18, 18P rotating forward passed through the fuser 9. As a result, the switchback roller pair 18, 18P inverts an advancing direction of the sheet SH once the sheet SH enters the temporary discharge passage 19G of the switchback guide part 19 and conveys the sheet SH downward so that the sheet SH exit from the temporary discharge passage 19G.

<Support Member, Conveying Roller, Driven Roller and Actuator>

As shown in FIG. 2, the support member 15 is provided at a rear end side of the main body 2 at a position between the sheet tray 2C and the fuser 9 in the up-down direction. Both ends of the support member 15 in the axial direction of the photoconductor are fixed to the pair of side frames 90 of the main body 2.

More specifically, the support member 15 includes a support member main body 50 shown in FIGS. 4 to 8 and a facing guide part 60 shown in FIGS. 4 and 6 to 8. In the present embodiment, the support member main body 50 is a resin member in which a guide part 55 and extending parts 59A and 59B are integrally locked. The facing guide part 60 is also a resin member. The support member main body 50 and the facing guide part 60 are manufactured by injection molding or the like of thermoplastic resin.

Figure 5:
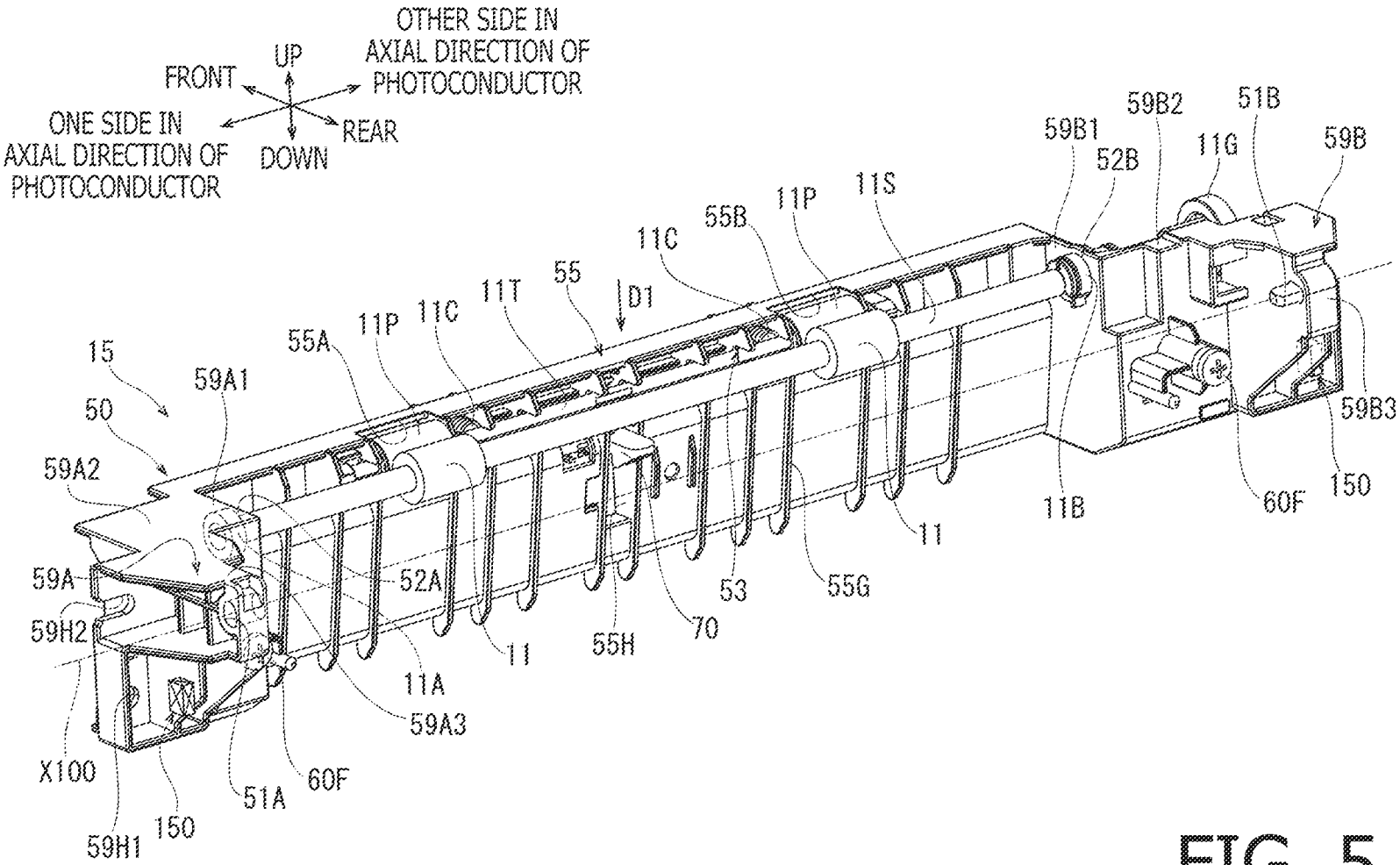
FIG. 5 is a perspective view of the support member in a state in which a facing guide part is removed.
Figure 6:
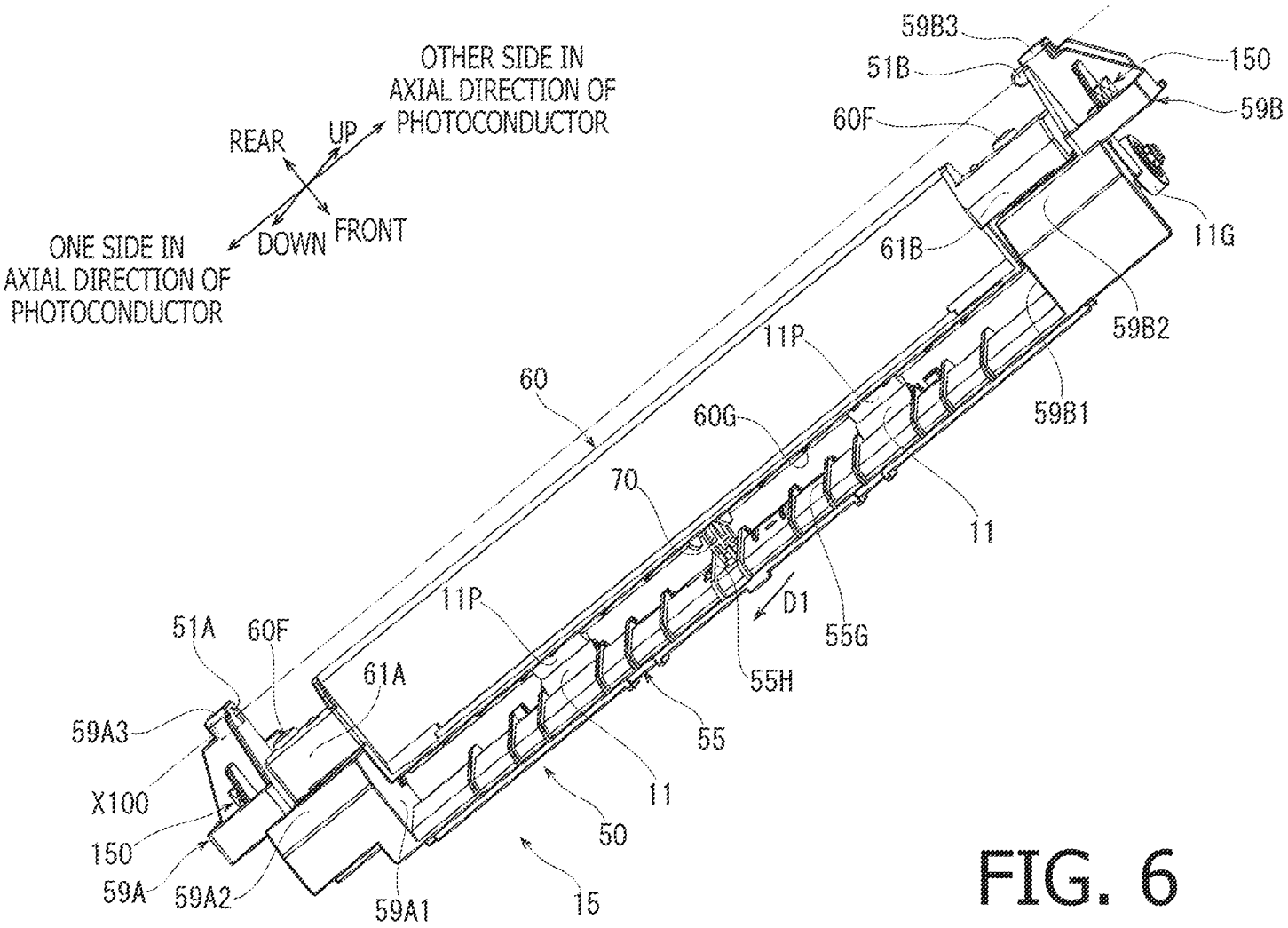
FIG. 6 is a perspective view showing a state in which the support member is looked up.

As shown in FIGS. 5 and 6, in the support member main body 50, the guide part 55 extends longer than a width of the maximum-size sheet SH in the axial direction of the photoconductor and extends in the up-down direction. A plurality of ribs are formed on a rear surface of the guide part 55 so as to project rearward. The ribs are arranged in the axial direction of the photoconductor while being spaced apart from each other and extend in the up-down direction. Leading edges of the ribs form a guide surface 55G.

The extending part 59A extends rearward from an end portion of the guide part 55 on one side in the axial direction of the photoconductor. More specifically, the extending part 59A includes a first portion 59A1, a second portion 59A2 and a third portion 59A3.

The first portion 59A1 is connected to the end portion of the guide part 55 on one side in the axial direction of the photoconductor and extends rearward. The second portion 59A2 is connected to a rear end of the first portion 59A1 and extends to one side in the axial direction of the photoconductor. The third portion 59A3 is connected to an end portion of the second portion 59A2 on one side in the axial direction of the photoconductor and extends rearward.

The extending part 59B extends rearward from an end portion of the guide part 55 on the other side in the axial direction of the photoconductor. More specifically, the extending part 59B includes a first portion 59B1, a second portion 59B2 and a third portion 59B3.

The first portion 59B1 is connected to the end portion of the guide part 55 on the other side in the axial direction of the photoconductor and extends rearward. The second portion 59B2 is connected to a rear end of the first portion 59B1 and extends to the other side in the axial direction of the photoconductor. The third portion 59B3 is connected to an end portion of the second portion 59B2 on the other side in the axial direction of the photoconductor and extends rearward.

As shown in FIG. 5, a fastening portion into which a screw 60F is to be screwed is formed on each of a rear surface of the second portion 59A2 of the extending part 59A and a rear surface of the second portion 59B2 of the extending part 59B.

Figure 8:
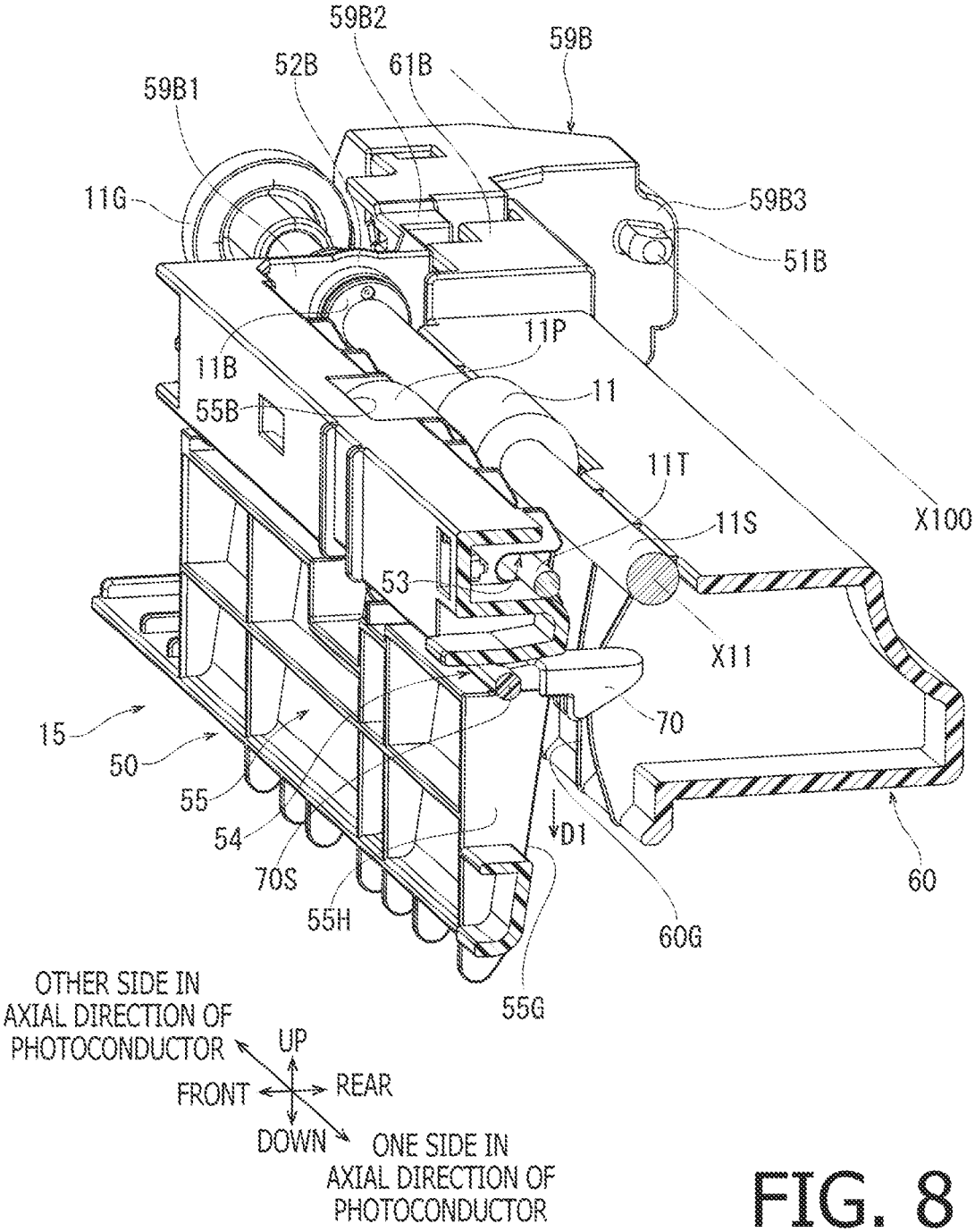
FIG. 8 is a partial perspective view showing a cross section of a portion of the support member, and shows a conveying roller, a driven roller and an actuator supported by the support member.

As shown in FIG. 8, the facing guide part 60 has a C-shaped cross section and extends in the axial direction of the photoconductor. A plurality of ribs are formed inside the C-shaped cross section of the facing guide part 60 so as to project forward. The ribs are arranged in the axial direction of the photoconductor while being spaced apart from each other and extend in the up-down direction. A distal end edge of each rib projects forward of a distal end of the C-shaped cross section of the facing guide part 60. Leading edges of the ribs form a guide surface 60G.

Figure 4:
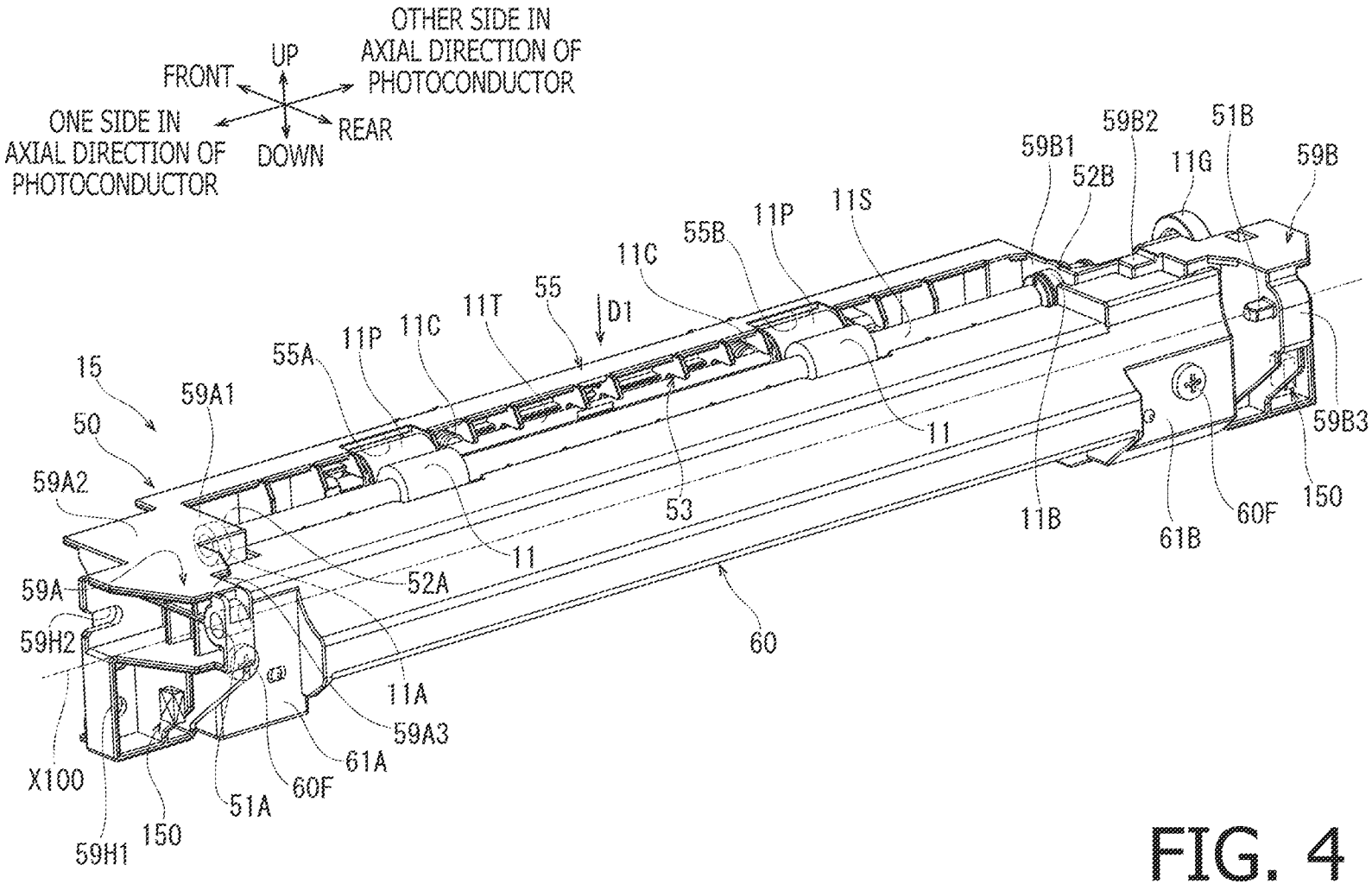
FIG. 4 is a perspective view of the support member.
Figure 7:
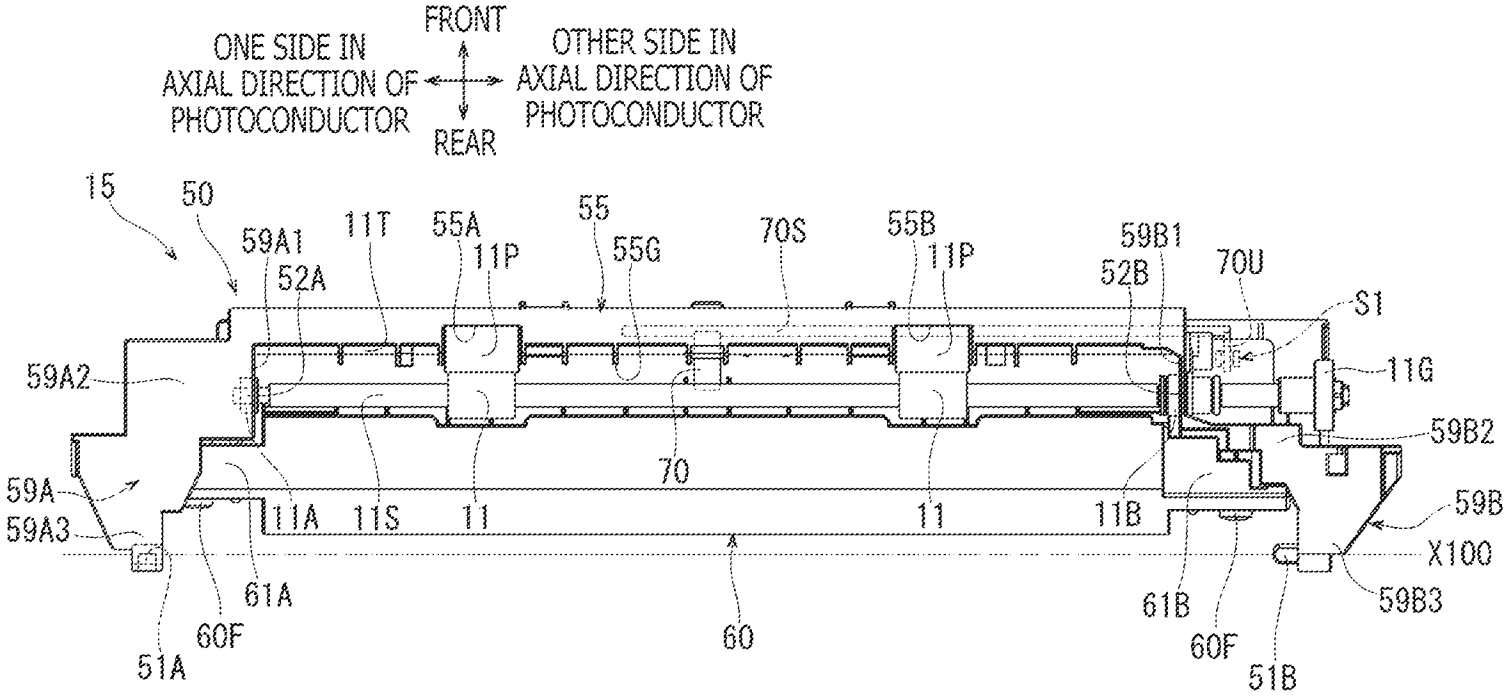
FIG. 7 is a top view of the support member.

As shown in FIGS. 4, 6 and 7, a coupling portion 61A is formed at one end of the facing guide pat 60 in the axial direction of the photoconductor. A coupling portion 61B is formed at the other end of the facing guide part 60 in the axial direction of the photoconductor.

In a state in which the coupling portion 61A of the facing guide part 60 is brought into contact with the second portion 59A2 of the extending part 59A of the support member main body 50 from behind, the screw 60F is inserted into a not-shown screw hole of the coupling portion 61A and is further screwed into a fastening portion formed to the second portion 59A2.

In a state in which the coupling portion 61B of the facing guide part 60 is brought into contact with the second portion 59B2 of the extending part 59B of the support member main body 50 from behind, the screw 60F is inserted into a not-shown screw hole of the coupling portion 61B and is further screwed into a fastening portion formed to the second portion 59B2.

As a result, the facing guide part 60 is coupled to the support member main body 50, and the facing guide part 60 reinforces the support member main body 50.

In this state, a facing guide surface 60G of the facing guide part 60 faces the guide surface 55G of the guide part 55. The third portions 59A3 and 59B3 of the extending parts 59A and 59B sandwich the facing guide part 60 in the axial direction of the photoconductor, further extend rearward, and project toward the opposite side of the guide part 55 with respect to the facing guide part 60.

As shown in FIG. 4, a hole 59H1 and a notch 59H2 into which screws are to be inserted when fixing the extending part 59A to the side frame 90 of the apparatus main body 2 on one side in the axial direction of the photoconductor is formed to the third portion 59A3 of the extending part 59A. Although not shown, similar hole and notch are also formed to the third portion 59B3 of the extending part 59B.

As shown in FIGS. 4 to 8, first shaft support parts 51A and 51B are provided at rear ends of the third portions 59A3 and 59B3 of the extending parts 59A and 59B. The first shaft support part 51A is a shaft hole being a through hole formed at a rear end of the third portion 59A3 of the extending part 59A, and is centered on a swing axis X100 extending in the axial direction of the photoconductor. The first shaft support part 51B is a shaft-like part protruding from a rear end of the third portion 59B3 of the extending part 59B toward one side in the axial direction of the photoconductor, and an outer peripheral surface of the first shaft support part 51B includes a portion of a cylindrical surface centered on the swing axis X100.

As will be described later, the first shaft support parts 51A and 51B support the first guide member 100 to be swingable about the swing axis X100.

As shown in FIGS. 4, 5 and 7, second shaft support parts 52A and 53B are provided at upper ends of the first portions 59A1 and 59B1 of the extending parts 59A and 59B. The second shaft support part 52A is a portion that holds a bearing 11A at the upper end of the first portion 59A1 of the extending part 59A. The second shaft support part 52B is a portion that holds a bearing 11B at the upper end of the first portion 59B1 of the extending part 59B.

Two conveying rollers 11 are fixed to a drive shaft 11S extending in the axial direction of the photoconductor while being separated from each other in the axial direction of the photoconductor. An end portion of the drive shaft 11S on one side in the axial direction of the photoconductor is inserted into the bearing 11A and supported by the second shaft support part 52A. An end portion of the drive shaft 11S on the other side in the axial direction of the photoconductor is inserted into the bearing 11B and supported by the second shaft support part 52B. The end portion of the drive shaft 11S on the other side in the axial direction of the photoconductor passes through the second shaft support part 52B, and a drive gear 11G is fixed to a tip of the end portion of the drive shaft 11S on the other side in the axial direction of the photoconductor.

In this way, the second shaft support parts 52A and 52B support the conveying rollers 11 to be rotatable about a rotation axis X11 shown in FIGS. 3 and 8. The conveying rollers 11 rotate as driving force from a conventionally-known drive source is transmitted to the drive shaft 11S via the drive gear 11G.

As shown in FIGS. 4, 5 and 8, driven roller accommodating parts 55A and 55B recessed forward are formed at an upper end of the guide part 55 at positions facing the two conveying rollers 11. A plurality of ribs arranged side by side with the driven roller accommodating parts 55A and 55B in the axial direction of the photoconductor are formed with third shaft support parts 53. The third shaft support part 53 is a groove recessed forward from a rear end edge of each rib.

The third shaft support parts 53 support a driven shaft 11T extending in the axial direction of the photoconductor so as to be slidable in the front-rear direction, that is, so as to be movable toward and away from the drive shaft 11S. Two driven rollers 11P are rotatably fitted around the drive shaft 11S while being accommodated in the driven roller accommodating parts 55A and 55B.

As shown in FIGS. 4 and 5, two compression coil springs 11C are held at two positions at the upper end of the guide part 55 adjacent to the driven roller accommodating parts 55A and 55B. The compression coil springs 11C bias the driven shaft 11T rearward so that the driven shaft 11T approaches the drive shaft 11S.

Thus, the third shaft support parts 53 rotatably support the driven roller 11P. The driven rollers 11P face the corresponding conveying rollers 11 and are pressed toward the corresponding conveying rollers 11 by the bias force of the compression coil springs 11C. The driven rollers 11P are driven to rotate by the corresponding conveying rollers 11 by being pressed against the corresponding conveying rollers 11 directly or with the sheet SH interposed therebetween.

As shown in FIG. 3, the conveying rollers 11 and the driven rollers 11P nip the sheet SH and rotate to convey the sheet SH in the re-conveying direction D1 toward the image formation engine 3. The re-conveying direction D1 at the nipping positions between the conveying rollers 11 and the driven rollers 11P is downward. The guide surface 55G of the guide part 55 and the facing guide surface 60G of the facing guide part 60 guide the sheet SH downward at downstream of the conveying rollers 11 in the re-conveying direction D1.

As shown in FIGS. 5, 6 and 8, at the center of the guide part 55 in the axial direction of the photoconductor, a rectangular hole 55H penetrating in the front-rear direction and extending in the up-down direction is formed. As shown in FIG. 8, the actuator 70 is a resin member formed integrally with a swing shaft 70S extending in the axial direction of the photoconductor.

A fourth shaft support part 54 is provided to the guide part 55 below the third shaft support parts 53. The fourth shaft support part 54 is a groove that is recessed rearward from a front surface of the guide part 55 and extends in the axial direction of the photoconductor. The fourth shaft support part 54 supports the swing shaft 70S.

The actuator 70 projects radially outward from a portion of the swing shaft 70S located within the rectangular hole 55H. A posture of the actuator 70 is held by a conventionally-known urging spring so that the actuator 70 protrudes rearward, and a distal end of the actuator 70 enters a gap between a plurality of ribs constituting the facing guide surface 60G.

The actuator 70 comes into contact with the leading edge of the sheet SH conveyed by the conveying roller 11 and swings about the swing shaft 70S. The actuator 70 moves downward and forward to retract into the rectangular hole 55H, thereby allowing the sheet SH to pass therethrough.

Thus, the fourth shaft support part 54 supports the actuator 70 to be swingable. As shown in FIG. 7, the swing shaft 70S extends further toward the other side in the axial direction of the photoconductor than the guide part 55, and a shutter 70U is integrally formed at a distal end of the swing shaft 70S. A photo-interrupter S1 is provided in the vicinity of the shutter 70U. Although not shown, the photo-interrupter S1 is fixed to a mounting portion formed to extend from the guide part 55 toward the other side in the axial direction of the photoconductor.

The shutter 70U swings integrally with the actuator 70 that swings about the swing shaft 70S and opens or blocks an optical path of the photo-interrupter S1. The controller C1 determines a position of the sheet SH conveyed by the conveying rollers 11 based on a detection signal of the photo-interrupter S1, and uses the position for timing control of the re-conveyer 10 and the like.

<First Guide Member>

The first guide member 100 is swingable between a first position shown in FIGS. 1 and 3 and a second position shown in FIG. 2 in a curved direction as shown by dashed line 100L. In the description of the shape of the first guide member 100, the front-rear direction and the up-down direction are based on the first position shown in FIGS. 1 and 3. The front-rear direction and the up-down direction shown in FIG. 9 correspond to the directions shown in FIGS. 1 and 3.

Figure 9:
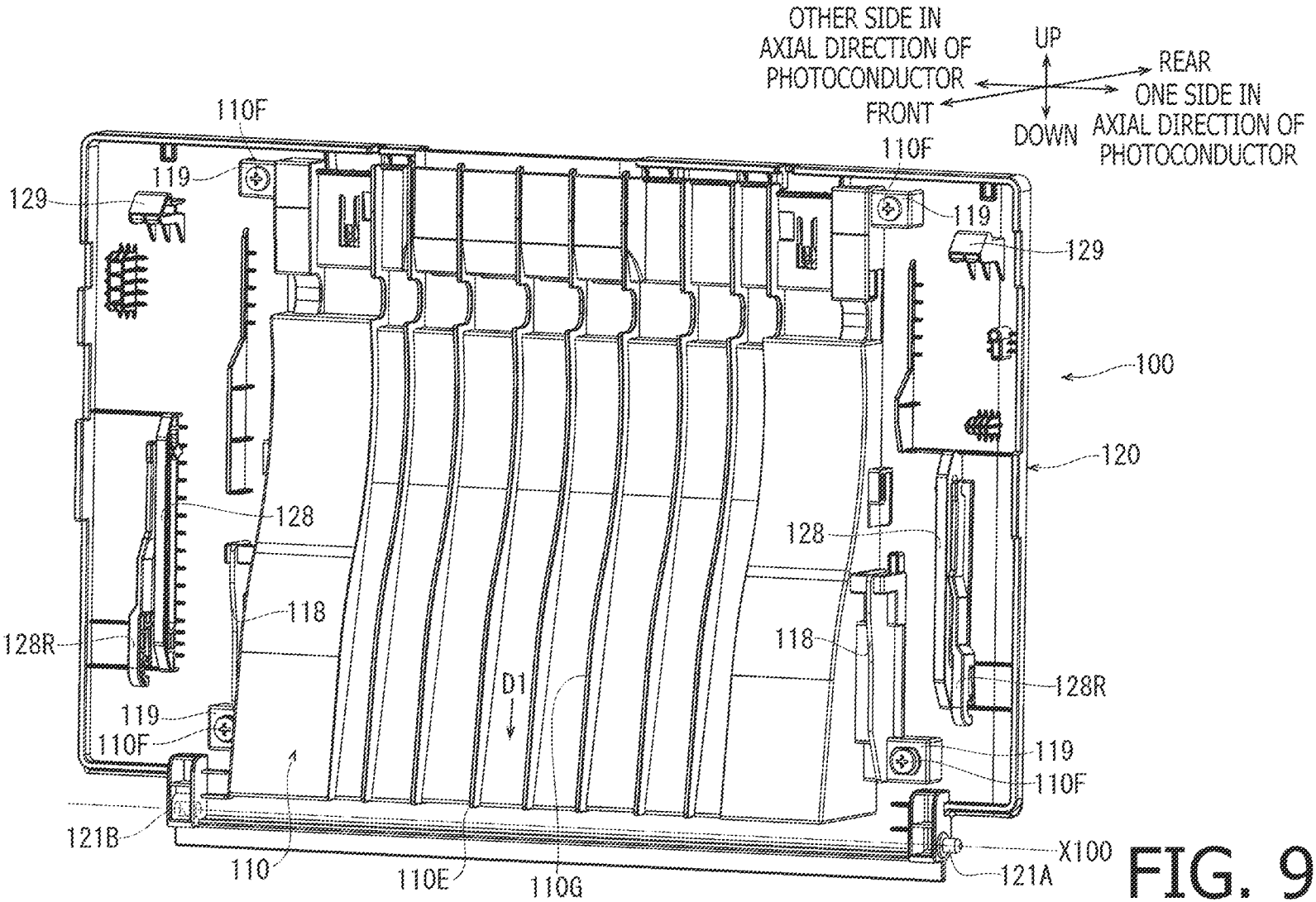
FIG. 9 is a perspective view of the first guide member.

As shown in FIG. 9, the first guide member 100 includes a first main body 110 and a rear cover 120. In the present embodiment, the first main body 110 and the rear cover 120 are resin members and are manufactured by injection molding or the like of thermoplastic resin.

The first main body 110 has a substantially rectangular shape when viewed in the front-rear direction, and a first guide surface 110G is formed on a front surface thereof. The first guide surface 110G is constituted by front end edges of a plurality of ribs arranged at intervals in the axial direction of the photoconductor and extending in the up-down direction, and curved surfaces positioned on one side and the other side in the axial direction of the photoconductor with respect to the ribs.

The first guide surface 110G extends downward from an upper end of the first main body 110, curves so as to be inclined forward at an intermediate portion in the up-down direction of the first main body 110, extends downward while making the inclination gentler, and reaches a lower end portion 110E. At an upper portion of the first guide surface 110G, a recess configured to accommodate a drive roller 18 of the switchback roller pair 18, 18P shown in FIG. 1 is formed.

Screw fixing parts 119 are formed at four corners of the first main body 110. Further, a pair of abutting part guide ribs 118 are formed on the first main body 110. The abutting part guide ribs 118 are provided so as to extend in the up-down direction and project forward along lower portions of respective side surfaces of the first main body 110 on one side and the other side in the axial direction of the photoconductor. An upper end of each abutting part guide rib 118 protrudes forward than a lower end thereof. A distal end edge of each abutting part guide rib 118 extends in a polygonal line shape from an upper end to a lower end thereof.

In FIGS. 1 to 3, the abutting part guide rib 118 located on the other side in the axial direction of the photoconductor with respect to the first guide surface 110G is indicated by a hidden line (broken line).

As shown in FIG. 9, the rear cover 120 is a flat plate member having a substantially rectangular shape when viewed in the front-rear direction. The first main body 110 is assembled to the rear cover 120 by inserting screws 110F into the screw fixing parts 119 at the four corners and further screwing the screws 110F into not-shown screw holes of the rear cover 120.

At corners of an upper end of the rear cover 120 on one side and the other side in the axial direction of the photoconductor, hook-shaped projections 129 projecting forward are respectively formed. In the vicinities of side edges of the rear cover 120 on one side and the other side in the axial direction of the photoconductor, link rails 128 projecting forward and extending in the up-down direction are respectively formed. One end of each of link levers 128R is coupled to corresponding link rail 128.

Corners of a lower end of the rear cover 120 on one side and the other side in the axial direction of the photoconductor are recessed in a stepped manner.

At the corner of the lower end of the rear cover 120 on one side in the axial direction of the photoconductor, a cylindrical shaft-like member 121A protruding toward one side in the axial direction of the photoconductor is formed. At the other corner of the lower end of the rear cover 120 on the other side in the axial direction of the photoconductor, a shaft hole 121B, being a bottomed circular hole that is recessed toward one side in the axial direction of the photoconductor, is formed. The shaft-like member 121A and the shaft hole 121B are centered on the swing axis X100 of the first guide member 100.

The shaft-like member 121A of the rear cover 120 is inserted into the first shaft support part 51A of the support member 15 shown in FIG. 4, and the first shaft support part 51B of the support member 15 shown in FIG. 4 is inserted into the shaft hole 121B of the rear cover 120. Thus, as shown in FIGS. 1 to 3, the extending parts 59A and 59B of the support member 15 support the first guide member 100 to be swingable about the swing axis X100 between the first position and the second position.

Although not shown, the other end of each of the link levers 128R shown in FIG. 9 is coupled to a rear end of corresponding side frame 90 of the main body 2. When the first guide member 100 is swung to the first position shown in FIGS. 1 and 3, the first guide member 100 is held at the first position by engagement of each of the hook-shaped projections 129 shown in FIG. 9 with the rear end of the corresponding side frame 90.

As shown in FIG. 1, the first position of the first guide member 100 is a position that defines a portion of the re-conveying path P2 upstream of the conveying rollers 11 in the re-conveying direction D1 and guides the sheet SH to the conveying roller 11.

More specifically, in a state where the first guide member 100 is at the first position, an upstream end 100A of the first guide member 100 in the re-conveying direction D1 is located at an uppermost position and is adjacent to a lower portion of the switchback guide part 19. In this state, the rear cover 120 of the first guide member 100 forms a portion of the rear surface of the main body 2. In this state, the first guide surface 110G defines a portion of the re-conveying path P2 from behind from a position below the switchback guide part 19 to a position above the conveying rollers 11. In this state, as shown in FIG. 3, the lower end portion 110E of the first guide surface 110G faces the conveying rollers 11 from above.

The first guide surface 110G of the first guide member 100 at the first position guides the sheet SH conveyed by the post-fixing conveying roller pair 25, 25P when the sheet SH is guided to behind the pre-discharge conveying roller pair 28, 28P by the path switching flapper 80 toward the switchback roller pair 18, 18P.

Further, the first guide surface 110G of the first guide member 100 at the first position guides the sheet SH, which is conveyed downward by the reverse rotation of the switchback roller pair 18, 18P, to the nipping positions between the conveying rollers 11 and the driven rollers 11P.

In this case, the flapper 40 at the restricting position restricts the sheet SH guided by the first guide surface 110G from advancing toward the fuser 9. Surfaces of the flapper 40 and the flapper support member 30 facing the first guide surface 110G also guide the sheet SH to the nipping positions between the conveying rollers 11 and the driven rollers 11P.

As shown in FIG. 2, the second position of the first guide member 100 is a position at which the upstream end 100A of the first guide member 100 is moved downward and rearward of the rear surface of the main body 2 to expose a portion of the re-conveying path P2. Although not shown, the second position of the first guide member 100 is held by a pair of link levers 128R shown in FIG. 9.

As shown in FIG. 3, the swing axis X100 of the first guide member 100 is located downstream of the rotation axis X11 of the conveying roller 11 in the re-conveying direction D1. More specifically, the swing axis X100 is located below an imaginary line K1 that extends horizontally in the front-rear direction perpendicular to the re-conveying direction D1 in the vicinity of the conveying roller 11 and passes through the rotation axis X11. Thus, when the first guide member 100 swings from the first position to the second position, the lower end portion 110E of the first guide surface 110G of the first guide member 100 traces a trajectory that gets farther from the re-conveying path P2.

<Second Guide Member and Oblique Feed Roller Pair>

Figure 10:
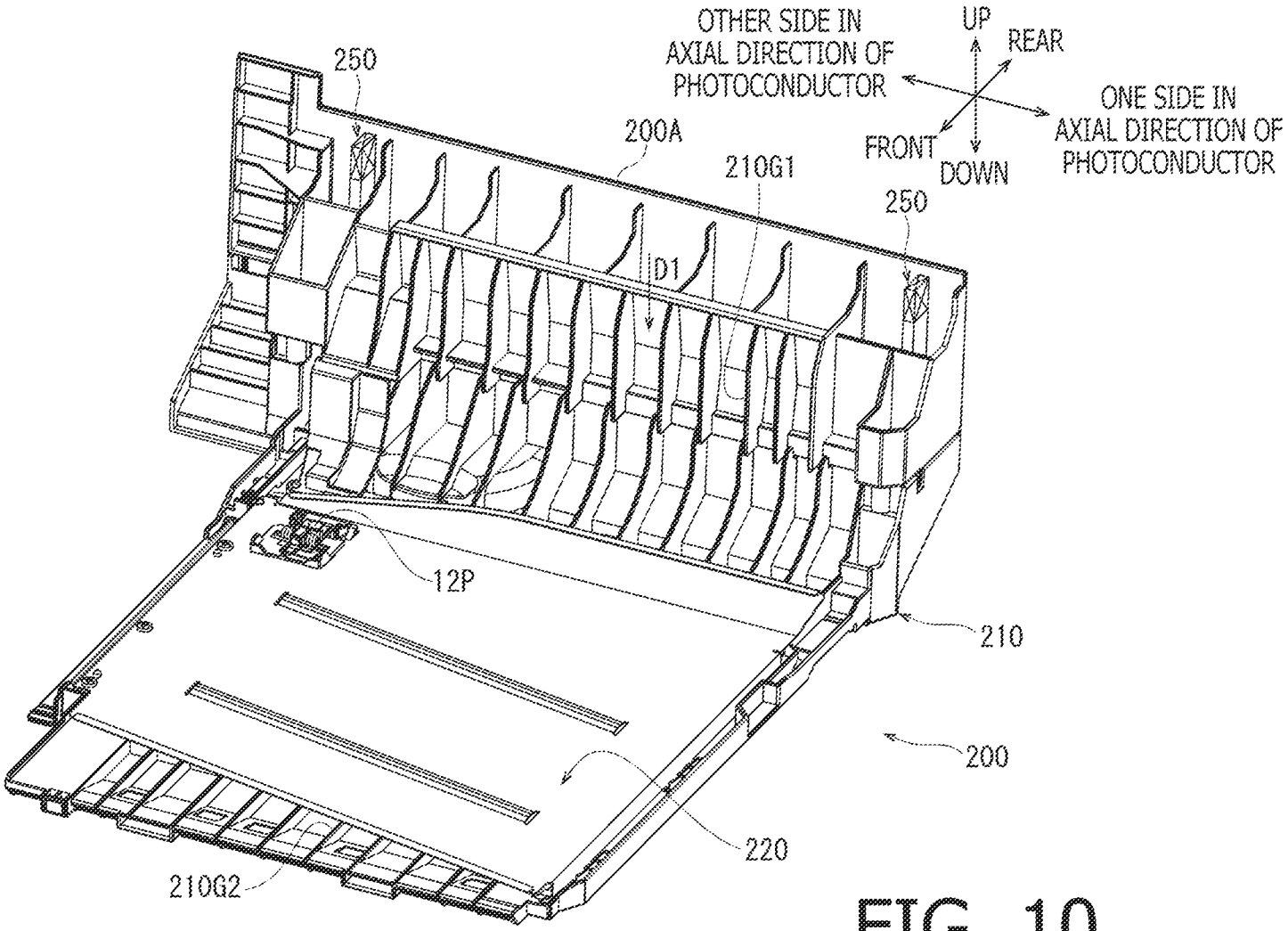
FIG. 10 is a perspective view of the second guide member.

As shown in FIGS. 1, 2, and 10, the second guide member 200 includes a second main body 210, a cover member 220, an oblique feed roller pair 12, 12P, and a pair of positioned parts 250.

The second main body 210 is formed by combining a plurality of resin members. A front portion of the second main body 210 extends in a flat plate shape in the front-rear direction and in the axial direction of the photoconductor. A rear portion of the second main body 210 projects higher than the front portion.

The cover member 220 is a sheet metal member extending in a flat plate shape in the front-rear direction and in the axial direction of the photoconductor. Edges of the cover member 220 on one side and the other side in the axial direction of the photoconductor are bent downward and coupled to the front portion of the second main body 210. The cover member 220 covers the front portion of the second main body 210 from above.

The oblique feed roller pair 12, 12P consists of an oblique feed roller 12P provided on the other side in the axial direction of the photoconductor at the back of the cover member 220, and a drive roller 12 provided at the back of the second main body 210 so as to face the oblique feed roller 12P from below as shown in FIG. 1.

Figure 11:
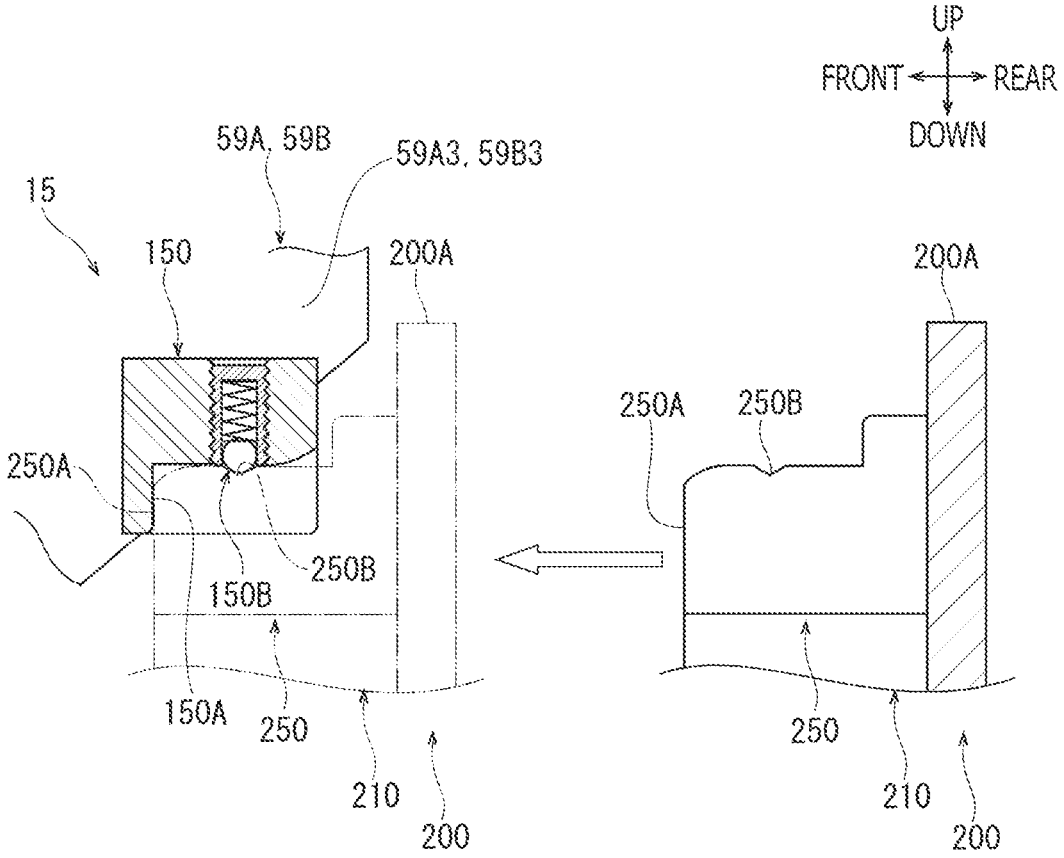
FIG. 11 is a partial schematic cross-sectional view showing a positioning part of the support member and a positioned part of the second guide member.

As shown in FIG. 10, the positioned parts 250 are provided at one end and the other end of an upper end of the rear portion of the second main body 210 in the axial direction of the photoconductor, respectively. As shown in FIG. 11, each positioned part 250 has a positioned surface 250A and a groove 250B.

The positioned surface 250A is a plane that faces forward and extends in the up-down direction. The groove 250B is a V-shaped groove when viewed in the axial direction of the photoconductor and is recessed downward on a surface extending rearward from an upper end of the positioned surface 250A.

As shown in FIGS. 4 to 6, positioning parts 150 are provided to the third portions 59A3 and 59B3 of the extending parts 59A and 59B of the support member 15, respectively. The positioning parts 150 are provided at positions corresponding to the positioned parts 250 shown in FIG. 10.

As shown in FIG. 11, each positioning part 150 has a positioning surface 150A and a ball-plunger 150B.

The positioning surface 150A is a flat surface facing rearward and extending in the up-down direction. The ball-plunger 150B has a ball biased downward by a compression coil spring. The ball-plunger 150B is provided so that a portion of the ball protrudes downward from the surface extending rearward from the upper end of the positioned surface 250A.

As shown in FIGS. 1 and 2, a slide rail 90R is provided at a lower end of each side frame 90 of the main body 2 so as to extend in the front-rear direction.

The second guide member 200 is mounted to the main body 2 by being accommodated in the main body 2 and supported by the slide rails 90R. A position of the second guide member 200 shown in FIGS. 1 and 3, that is, a position of the second guide member 200 that is mounted to the apparatus main body 2 is referred to as a third position.

As shown in FIG. 2, the second guide member 200 is guided by the slide rails 90R to slide rearward from inside the main body 2 in a direction as shown by dashed line 200L, and can be removed from the main body 2 by pulling the second guide member 200 out. The second guide member 200 can be mounted to the main body 2 by reversing the detaching operation. A position of the second guide member 200 shown in FIG. 2, that is, a position of the second guide member 200 that is removed from the main body 2 is referred to as a fourth position.

Thus, the second guide member 200 is slidable between the third position shown in FIGS. 1 and 3 and the fourth position shown in FIG. 2. When the second guide member 200 slides from the fourth position to the third position, the positioned surface 250A of the positioned part 250 comes into contact with the positioning surface 150A of the positioning part 150 as shown with chain double-dotted lines in FIG. 11, and the ball of the ball-plunger 150B of the positioning part 150 enters the groove 250B of the positioned part 250 to maintain the state in which the positioned surface 250A is in contact with the positioning surface 150A. Thus, an upstream end 200A of the second guide member 200 in the re-conveying direction D1 is positioned with respect to the support member 15 in a state where the second guide member 200 is at the third position.

As shown in FIGS. 1, 2 and 10, the second main body 210 has a curved conveying surface 210G1 and a horizontal conveying surface 210G2. The curved conveying surface 210G1 is formed to a rear portion of the second main body 210. The horizontal conveying surface 210G2 is formed to a front portion of the second main body 210.

As shown in FIG. 1, in a state where the second guide member 200 is at the third position, an upper end of the curved conveying surface 210G1 is located below the facing guide surface 60G of the support member 15. The curved conveying surface 210G1 curves while extending downward from the upper end and, below the sheet tray 2C, the curved conveying surface 210G1 changes its orientation to the forward direction. The horizontal conveying surface 210G2 is connected to a lower end of the curved conveying surface 210G1 and extends horizontally forward.

That is, the third position of the second guide member 200 is a position at which the curved conveying surface 210G1 and the horizontal conveying surface 210G2 define another portion of the re-conveying path P2 downstream of the conveying rollers 11 in the re-conveying direction D1 to guide the sheet SH conveyed by the conveying roller 11.

The oblique feed roller pair 12, 12P nips the sheet SH guided by the horizontal conveying surface 210G2 and moves the sheet SH toward the other side in the axial direction of the photoconductor while conveying the sheet SH in the re-conveying direction D1 to align the sheet SH along a not-shown reference surface, thereby positioning the sheet SH in the axial direction of the photoconductor.

<Third Guide Member and Return Roller Pair>

The third guide member 300 is fixed to the beam member 99. The third guide member 300 has a conveying surface 300G and a return roller pair 13, 13P.

The conveying surface 300G is connected to the horizontal conveying surface 210G2 of the second guide member 200 at the third position. The return roller pair 13, 13P nips the sheet SH guided to the conveying surface 300G and conveys the sheet SH in the re-conveying direction D1.

<Return Guide Part>

The return guide part 2G is provided inside a front end portion of the sheet tray 2C and defines a most downstream portion of the re-conveying path P2. More specifically, a bulging portion 2C1 is formed at the front end portion of the sheet tray 2C. The bulging portion 2C1 is bulged lower than a bottom surface of the sheet tray 2C and faces the third guide member 300 from the front.

An inlet of the return guide part 2G is open on a surface of the bulging portion 2C1 facing rearward. An outlet of the return guide part 2G is open on a surface of the front end portion of the sheet tray 2C facing upward. The return guide part 2G is connected to the conveying surface 300G of the third guide member 300, changes its orientation from forward to upward at the front of the main body 2, and merges with the conveying path P1.

<Flapper, Flapper Support Member and Torsion Coil Spring>

The flapper 40 and the flapper support member 30 are configured to tilt rearward together with the first guide member 100 in conjunction with the swinging of the first guide member 100 from the first position shown in FIGS. 1 and 3 to the second position shown in FIG. 2. Detailed configuration for this movement will be described below.

Shapes of the flapper 40 and the flapper support member 30 will be described based on the postures illustrated in FIGS. 1 and 3 to describe the front-rear direction and the up-down direction. The front-rear direction and the up-down direction shown in FIG. 12 correspond to the directions shown in FIGS. 1 and 3.

Figure 12:
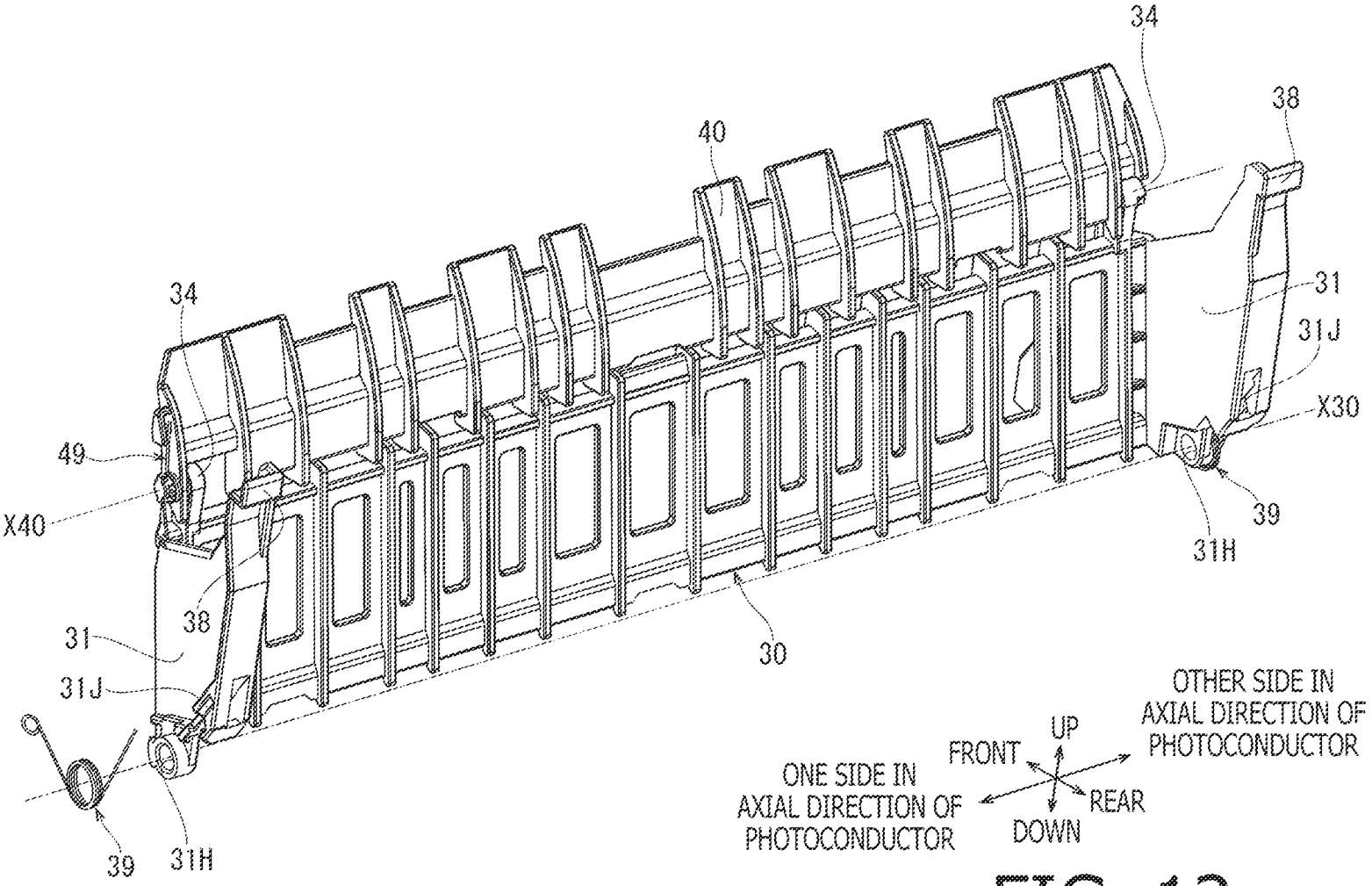
FIG. 12 is a perspective view showing a flapper, a flapper support member, and a torsion coil spring.

As shown in FIG. 12, the flapper support member 30 extends longer than the width of the maximum-size sheet SH in the axial direction of the photoconductor and extends in the up-down direction. Support projections 34 projecting upward are formed to upper portions of the flapper support member 30 on one side and the other side in the axial direction of the photoconductor, respectively.

The flapper support member 30 supports the flapper 40, with a pair of support projections 34, to be swingable about the first axis X40. Torsion coil springs 49 configured to urge the flapper 40 toward the restricting position are provided in the vicinity of respective support projections 34.

Side walls 31 projecting rearward are formed on side edges of the flapper support member 30 on one side and the other side in the axial direction of the photoconductor, respectively. At a lower end of each side wall 31, a shaft hole 31H extending in the axial direction of the photoconductor and centered on a second axis X30 is formed. A spring locking part 31J is formed to each side wall 31 at a position behind and above of the shaft hole 31H. A rear upper portion of each side wall 31 projects upward, and an abutting part 38 is formed at an upper end of the projecting portion.

As shown in FIG. 3, the fuser 9 includes not-shown support shafts defining the second axis X30, and spring locking parts 9J provided above and in front of respective support shafts. The support shafts are inserted into the shaft holes 31H of the flapper support member 30, whereby the flapper support member 30 is supported by the fuser 9 so as to be swingable about the second axis X30.

As shown in FIG. 12, the image forming apparatus 1 further includes a pair of torsion coil springs 39. Coil portions of the pair of torsion coil springs 39 are disposed in the vicinity of the shaft hole 31H of the pair of side walls 31 so as to be centered on the second axis X30.

As shown in FIG. 3, one end of each torsion coil spring 39 is locked to corresponding spring locking part 31J of the flapper support member 30. The other end of each torsion coil spring 39 is locked to corresponding spring locking part 9J of the fuser 9.

Each torsion coil spring 39 stores restoring force to separate one end and the other end of the torsion coil spring 39 from each other in a state where the first guide member 100 is at the first position. Thus, the torsion coil springs 39 bias the flapper support member 30 so that a pair of abutting parts 38 of the flapper support member 30 abuts a pair of abutting part guide ribs 118 of the first guide member 100. As a result, the flapper support member 30 is positioned with respect to the first guide member 100 and is made less likely to wobble.

As shown in FIG. 2, although the restoring force of each torsion coil spring 39 decreases as the first guide member 100 swings to the second position, the torsion coil spring 39 still store the restoring force to separate one end and the other end of the torsion coil spring 39 from each other. Therefore, the torsion coil springs 39 bias the flapper support member 30 so that the pair of abutting parts 38 of the flapper support member 30 abut the pair of abutting part guide ribs 118 of the first guide member 100. As a result, the pair of abutting parts 38 slide with respect to the pair of abutting part guide ribs 118, and the flapper 40 and the flapper support member 30 tilt rearward together with the first guide member 100.

<Operation of Re-Conveyer for Executing Process of Forming Images on Both Surfaces of Sheet in Partially Overlapped Manner>

The image forming apparatus 1 can simultaneously process a plurality of sheets SH inside the image forming apparatus 1 in order to increase process speed for forming images on both sides of the sheet SH. For example, the sheet SH having an image formed on one surface SH1 is caused to stand by in the middle of the re-conveying path P2, and the next sheet SH is conveyed from the sheet tray 2C to the image formation engine 3.

In this case, the controller C1 controls the re-conveyer 10 based on detection of presence or absence of the sheet SH by the actuator 70 or the detection of the presence or absence of the sheet SH by a conventionally-known actuator provided to the third guide member 300 to stop the conveying rollers 11, the driven rollers 11P, the oblique feed roller pair 12, 12P and the return roller pair 13, 13P before the leading edge of the sheet SH enters the conveying path P1 from the return guide part 2G. The sheet SH is thereby caused to standby in the middle of the re-conveying path P2.

Then, the controller C1 feeds the next sheet SH from the sheet tray 2C, forms an image on one surface SH1 of the sheet SH with the image formation engine 3, and conveys the sheet SH to the re-conveying path P2. Then, the controller C1 causes the conveying rollers 11, the driven rollers 11P, the oblique feed roller pair 12, 12P and the return roller pair 13, 13P to rotate, and resumes the conveyance of the sheet SH that has been made to standby to cause the sheet SH to enter the conveying path P1.

By such a standby operation, the image forming apparatus 1 can successfully perform the operation of simultaneously processing a plurality of sheets SH inside the image forming apparatus 1.

<Removal of Sheet Jammed in Re-Conveying Path>

As shown in FIG. 2, in the image forming apparatus 1, in a case where the sheet SH is jammed in the re-conveying path P2 upstream of the conveying rollers 11 in the re-conveying direction D1, by swinging the first guide member 100 to the second position, the jammed sheet SH can be easily taken out.

Further, in the image forming apparatus 1, in a case where the sheet SH is jammed in the re-conveying path P2 downstream of the conveying rollers 11 in the re-conveying direction D1, by sliding the second guide member 200 to the fourth position and removing the second guide member 200 from the apparatus main body 2, the jammed sheet SH can be easily taken out.

<Effects>

In the image forming apparatus 1 according to the embodiment, as shown in FIG. 2, by swinging the first guide member 100 to the second position, it is possible to remove the sheet SH jammed around the conveying rollers 11.

In the image forming apparatus 1, as shown in FIG. 3, the first guide member 100 and the conveying rollers 11 are supported by the same support member 15. More specifically, as shown in FIGS. 4 and 9, the first shaft support parts 51A and 51B of the support member 15 support the first guide member 100 to be swingable about the swing axis X100. As shown in FIG. 5, the second shaft support parts 52A and 52B of the support member 15 support the conveying rollers 11 to be rotatable about the rotation axis X11. With this configuration, it is possible to improve positional relationship accuracy between the first guide surface 110G of the first guide member 100 at the first position and the conveying rollers 11. Therefore, with the image forming apparatus 1, it is possible to suppress variation in positions at which a leading edge of the sheet SH guided to the conveying rollers 11 by the first guide surface 110G of the first guide member 100 at the first position contacts the conveying rollers 11.

Therefore, with the image forming apparatus 1 according to the embodiment, it is possible to suppress jamming of the sheet SH around the conveying rollers 11 provided in the middle of the re-conveying path P2.

In the image forming apparatus 1, as shown in FIG. 3, the swing axis X100 of the first guide member 100 is located downstream of the rotation axis X11 of the conveying rollers 11 in the re-conveying direction D1, that is, below the imaginary line K1.

With this configuration, as shown in FIG. 2, since it is possible to widely open the periphery of the conveying roller 11 by swinging the first guide member 100 to the second position, it is easy to insert a hand into the periphery of the conveying roller 11 when removing the jammed sheet SH or the like. Therefore, with the image forming apparatus 1, it is possible to prevent the jammed sheet SH from being torn when the jammed sheet SH is pulled. Further, the lower end portion 110E of the first guide surface 110G of the first guide member 100 traces a trajectory that gets farther from the re-conveying path P2 when the first guide member 100 swings from the first position to the second position. Therefore, with the image forming apparatus 1, it is possible to prevent the sheet from being torn by the lower end portion 110E.

Further, in the image forming apparatus 1, as shown in FIG. 5, the support member 15 supporting the conveying rollers 11 and the first guide member 100 rotatably supports the driven roller 11P with the third shaft support parts 53.

With this configuration, it is possible to improve positional relationship accuracy between the conveying rollers 11 and the driven roller 11P, and it is also possible to improve positional relationship accuracy between the first guide surface 110G of the first guide member 100 at the first position and the nipping positions between the conveying rollers 11 and the driven rollers 11P. As a result, in the image forming apparatus 1, the first guide surface 110G of the first guide member 100 at the first position can smoothly guide the leading edge of the sheet SH to the nipping positions between the conveying rollers 11 and the driven rollers 11P.

In the image forming apparatus 1, as shown in FIG. 8, the support member 15 that supports the conveying rollers 11 swingably supports the actuator 70 with the fourth shaft support part 54.

With this configuration, it is possible to improve positional relationship accuracy between the conveying rollers 11 and the actuator 70. Therefore, with the image forming apparatus 1, detection accuracy of the leading edge of the sheet SH conveyed by the conveying rollers 11 can be improved. As a result, in the image forming apparatus 1, timing control when the re-conveyer 10 re-conveys the sheet SH can be accurately performed.

Further, in the image forming apparatus 1, as shown in FIGS. 3 and 12, the lower end of the flapper support member 30 that supports the flapper 40 to be swingable about the first axis X40 is supported by the fuser 9 such that the flapper support member 30 is swingable about the second axis X30, and the flapper support member 30 has a pair of abutting parts 38. The torsion coil springs 39 bias the flapper support member 30 so that the pair of abutting parts 38 of the flapper support member 30 abut the pair of abutting part guide ribs 118 of the first guide member 100 in a state where the first guide member 100 is at the first position shown in FIGS. 1 and 4 and in a state where the first guide member 100 is at the second position shown in FIG. 2.

With this configuration, as shown in FIG. 3, in a state in which the first guide member 100 is at the first position, the flapper support member 30 biased by the torsion coil springs 39 is positioned with respect to the first guide member 100 and thus is less likely to wobble. As a result, the flapper 40 can smoothly and accurately swing between the retracted position indicated by the chain double-dotted line in FIG. 3 and the restricting position indicated by the solid line in FIG. 3. Also, as shown in FIG. 2, as the first guide member 100 swings to the second position, the flapper support member 30 and the flapper 40 tilt together with the first guide member 100. As a result, the outlet of the fuser 9 opens and thus removal of the sheet SH jammed in the fuser 9 and the like can be easily performed. Further, in a case where the sheet SH (SHa) having passed through the fuser 9 is to be discharged onto the first guide member 100 in a state where the first guide member 100 is at the second position, that is, in a case where a straight discharge operation is to be performed, the titled flapper support member 30 and flapper 40 are unlikely to interfere with the discharged sheet SH (SHa).

Further, with the image forming apparatus 1, by the configuration in which the first guide member 100 including the rear cover 120 is supported by the support member 15 fixed to the pair of side frames 90 of the main body 2 as shown in FIGS. 1, 2, and 9, it is possible to suppress formation of unevenness between a portion of the rear surface the main body 2 and the remaining portion.

In the image forming apparatus 1, the second guide member 200 is movable between the third position shown in FIG. 1 and the fourth position shown in FIG. 2. The upstream end 200A of the second guide member 200 in the re-conveying direction D1 is positioned with respect to the support member 15 by the positioning parts 150 and the positioned parts 250 as shown in FIG. 12 in a state where the second guide member 200 is at the third position.

With this configuration, in the image forming apparatus 1, by moving the second guide member 200 to the fourth position, it is possible to perform removal of the sheet SH jammed downstream of the conveying rollers 11 in the re-conveying direction D1 and the like. With the configuration in which the upstream end 200A of the second guide member 200 at the third position is positioned by the support member 15 supporting the conveying rollers 11 and the first guide member 100, it is possible to improve the positional relationship accuracy between the first guide surface 110G of the first guide member 100 at the first position, the conveying rollers 11, and the curved conveying surface 210G1 of the second guide member 200 at the third position. As a result, in the image forming apparatus 1, the sheet SH can be smoothly conveyed along the re-conveying path P2 by the first guide surface 110G of the first guide member 100 at the first position, the conveying rollers 11, and the curved conveying surface 210G1 of the second guide member 200 at the third position.

In the image forming apparatus 1, as shown in FIGS. 1 and 2, the second guide member 200 slides between the third position at which the second guide member 200 is attached to the main body 2 and the fourth position at which the second guide member 200 is detached from the main body 2.

With this configuration, by sliding the second guide member 200 to the fourth position and detaching it from the main body 2, it is possible to easily perform removal of the sheet SH jammed downstream of the conveying rollers 11 in the re-conveying direction D1.

Further, in the image forming apparatus 1, as shown in FIGS. 3 and 5, the support member 15 has the guide part 55 to which the guide surface 55G is formed.

With this configuration, it is possible to improve positional relationship accuracy between the conveying rollers 11 and the guide surface 55G of the guide part 55, and thus it is possible to smoothly convey the sheet SH along the re-conveying path P2.

In the image forming apparatus 1, as shown in FIGS. 3 and 6, the support member 15 includes the facing guide part 60 to which the facing guide surface 60G is formed, and the extending parts 59A and 59B extending from the guide part 55. The first shaft support parts 51A and 51B formed to the extending parts 59A and 59B swingably support the first guide member 100.

With this configuration, it is possible to improve positional relationship accuracy between the first guide member 100 at the first position, the conveying rollers 11, the guide surface 55G of the guide part 55 and the facing guide surface 60G of the facing guide part 60, and thus it is possible to smoothly convey the sheet SH along the re-conveying path P2.

In the image forming apparatus 1, as shown in FIG. 1, the upstream end 100A of the first guide member 100 in the re-conveying direction D1 is at the uppermost position in a state where the first guide member 100 is at the first position. As shown in FIG. 2, the upstream end 100A of the first guide member 100 moves downward and rearward relative to the rear surface of the main body 2 as the first guide member 100 swings to the second position.

With this configuration, it is easy for a user to swing the first guide member 100 between the first position and the second position, and it is easy for the user to insert his/her hand around the conveying rollers 11 in a state where the first guide member 100 is swung to the second position.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein.

In the embodiment, the second guide member 200 slides between the third position and the fourth position and is detached from the main body 2 at the fourth position. However, for example, the second guide member may swing between the third position and the fourth position, and may not be detached from the main body at the fourth position.

In the embodiment, the upstream end 200A of the second guide member 200 in the re-conveying direction D1 is positioned with respect to the support member 15 by the positioning parts 150 and the positioned parts 250 in a state where the second guide member 200 is at the third position. However, for example, a configuration in which the positioning parts 150 and the positioned parts 250 are eliminated from the image forming apparatus 1 of the embodiment is also part of the present disclosure.

In the embodiment, the torsion coil spring 39 is employed as a biasing member configured to bias the flapper support member 30. However, for example, a compression coil spring may be employed as the biasing member.

In the embodiment, the swing axis X100 of the first guide member 100 is located downstream of the rotation axis X11 of the conveying rollers 11 in the re-conveying direction D1. However, for example, the swing axis of the first guide member may be located upstream of the rotation axis of the conveying roller in the re-conveying direction, or may be located at the same position as the rotation axis of the conveying roller in the re-conveying direction.

In the embodiment, the support member 15 supports the driven rollers 11P and the actuator 70. However, for example, a member different from the support member, specifically, an inner frame different from the housing or the support member may support the driven roller and the actuator.

In the embodiment, the first guide member 100 is configured to move integrally with the rear cover. However, for example, the rear cover and the first guide member may be configured to swing separately.

In the embodiment, the image forming apparatus 1 is a laser printer. However, for example, aspects of the present disclosure may be applied to an image forming system different from the laser system, such as an LED printer, an inkjet printer, or a thermal printer.

In the embodiment, the re-conveying path P2 is configured to branch from the conveying path P1 and to have the independent switchback section, but the present disclosure is not limited to this configuration. That is, the switching member 80 and the switchback roller pair 18, 18P may be eliminated from the image forming apparatus 1, and a section of the conveying path P1 from the pre-discharge conveying roller pair 28, 28P to the discharge roller pair 29, 29P may be configured to also serve as the switchback section of the re-conveying path P2. In this case, the sheet SH having passed through the fuser 9 is nipped by the pre-discharge conveying roller pair 28, 28P and the discharge roller pair 29, 29P and is partially discharged from the conveying path P1, and is then conveyed by the pre-discharge conveying roller pair 28, 28P and the discharge roller pair 29, 29P whose rotation directions have been switched to the directions opposite to those at the time of discharge so that the sheet SH switches back. Then, the first guide surface 110G of the first guide member 100 guides the conveyed sheet SH toward the conveying rollers 11.

Aspects of the present disclosure can be applied not only to image forming apparatuses but also to multifunction peripherals or the like.

The image forming apparatus 1 in the above-described embodiment is an example of an image forming apparatus according to aspects of the present disclosures. The pair of torsion coil springs 39 in the above-described embodiment is an example of a biasing member according to aspects of the present disclosures.

What is claimed is:

1. An image forming apparatus comprising:

an image formation engine configured to form an image on a sheet; and a re-conveyer configured to convey the sheet having an image formed on one surface thereof by the image formation engine to the image formation engine again along a re-conveying path, the re-conveyer including:

a conveying roller configured to convey the sheet in a re-conveying direction toward the image formation engine;

a first guide member configured to be swingable between a first position at which the first guide member defines a portion of the re-conveying path upstream of the conveying roller in the re-conveying direction and guides the sheet to the conveying roller and a second position for exposing the portion of the re-conveying path; and a support member configured to swingably support the first guide member and rotatably support the conveying roller.

2. The image forming apparatus of claim 1, wherein a swing axis of the first guide member is located downstream of a rotation axis of the conveying roller in the re-conveying direction.

3. The image forming apparatus of claim 1, wherein the re-conveyer includes a driven roller that faces the conveying roller and is driven by the conveying roller, and wherein the support member rotatably supports the driven roller.

4. The image forming apparatus of claim 1, wherein the support member supports an actuator configured to move upon contact with a leading edge of the sheet conveyed by the conveying roller.

5. The image forming apparatus of claim 1, further comprising:

a fuser configured to thermally fix the image on the sheet having passed through the image formation engine;

a flapper configured to be swingable between a retracted position at which the flapper is swung by being pressed by the sheet having passed through the fuser and a restricting position at which the flapper restricts the sheet guided by the first guide member from advancing toward the fuser;

a flapper support member configured to swingably support the flapper, a lower end of the flapper support member being swingably supported by the fuser, the flapper support member including an abutting part configured to abut the first guide member; and a biasing member configured to bias the flapper support member so that the abutting part of the flapper support member abuts the first guide member in a state where the first guide member is at the first position and the second position.

6. The image forming apparatus of claim 1 comprising a main body, wherein the support member is fixed to the main body, and wherein the first guide member forms a portion of a side surface of the main body in a state where the first guide member is at the first position.

7. The image forming apparatus of claim 1, wherein the re-conveyer further includes a second guide member configure to be movable between a third position at which the second guide member defines another portion of the re-conveying path downstream of the conveying roller in the re-conveying direction and guides the sheet conveyed by the conveying roller, and a fourth position for exposing the other portion of the re-conveying path, and wherein an upstream end of the second guide member in the re-conveying direction is positioned with respect to the support member in a state where the second guide member is at the third position.

8. The image forming apparatus of claim 7 comprising a main body, wherein the support member is fixed to the main body, and wherein the second guide member is configured to slide between the third position at which the second guide member is attached to the main body and the fourth position at which the second guide member is detached from the main body.

9. The image forming apparatus of claim 1, wherein the support member includes a guide part configured to guide the sheet downstream of the conveying roller in the re-conveying direction.

10. The image forming apparatus of claim 9, wherein the support member includes:

a facing guide part that faces the guide part and guides the sheet; and extending parts that extend from the guide part to sandwich the facing guide part in a direction in which a swing axis of the first guide member extends and further protrude with respect to the facing guide part toward a side opposite to the guide part wherein the extending parts swingably supports the first guide member.

11. The image forming apparatus of claim 1, wherein an upstream end of the first guide member in the re-conveying direction is located at an uppermost position in a state where the first guide member is at the first position, and moves downward and outward with respect to the image forming apparatus as the first guide member swings to the second position.

12. An image forming apparatus comprising:

an image formation engine configured to form an image on a sheet;

a fuser configured to thermally fix the image on the sheet having passed through the image formation engine;

a rear cover having a first guide surface, the rear cover being configured to be swingable between a first position at which the first guide surface defines a portion of a re-conveying path and a second position for exposing the portion of the re-conveying path, the first guide surface being configured to guide the sheet passed through the fuser in a conveying direction and to guide the sheet whose advancing direction is inverted to be conveyed in a re-conveying direction when the rear cover is at the first position;

a conveying roller configured to convey the sheet in the re-conveying direction toward the image formation engine;

a supporter having a second guide surface and configured to swingably support the rear cover and rotatably support the conveying roller downstream of the first guide surface and upstream of the second guide surface in the re-conveying direction, the second guide surface being configured to guide the sheet in the re-conveying direction.

* * * * *